US007428787B2

(12) United States Patent
Crowley, II et al.

(10) Patent No.: US 7,428,787 B2
(45) Date of Patent: Sep. 30, 2008

(54) REMOVABLE SHOE COVERINGS

(75) Inventors: Kevin J. Crowley, II, Merrimac, MA (US); David E. Miller, Dayton, ME (US); Tsui Hua Lin, Taichung (TW)

(73) Assignee: The Timberland Company, Stratham, NH (US)

( * ) Notice: Subject to any disclaimer, the term of this patent is extended or adjusted under 35 U.S.C. 154(b) by 340 days.

(21) Appl. No.: 11/108,963

(22) Filed: Apr. 19, 2005

(65) Prior Publication Data

US 2005/0235522 A1 Oct. 27, 2005

Related U.S. Application Data

(60) Provisional application No. 60/636,457, filed on Dec. 16, 2004, provisional application No. 60/565,163, filed on Apr. 23, 2004.

(51) Int. Cl.
*A43B 3/00* (2006.01)
*A43B 3/24* (2006.01)

(52) U.S. Cl. ..... 36/2 R; 36/1.5; 36/100; 36/101

(58) Field of Classification Search ..... 36/1.5, 36/2 R, 100, 101, 109, 72 R, 7.1 R; 24/399, 24/400

See application file for complete search history.

(56) References Cited

U.S. PATENT DOCUMENTS 342,152 A * 5/1886 Welton ..... 36/1.5
854,274 A * 5/1907 Crook et al. ..... 36/1.5
879,282 A 2/1908 Mandeville
951,336 A * 3/1910 Rasmussen ..... 36/72 R
1,736,013 A * 11/1929 Peachey ..... 36/1.5
1,844,997 A * 2/1932 Weigle ..... 36/1.5
2,097,200 A 10/1937 Menutole
2,199,029 A 4/1940 Murphy
2,241,841 A 5/1941 Beckwith
2,368,314 A * 1/1945 Marx ..... 36/11.5
2,519,108 A 8/1950 Bryant et al.
2,552,943 A 5/1951 Danielus
2,761,224 A 9/1956 Gardner
3,012,341 A * 12/1961 Schaefer ..... 36/100

(Continued)

FOREIGN PATENT DOCUMENTS

EP 0 750 859 1/1997

(Continued)

*Primary Examiner*—Marie Patterson
(74) *Attorney, Agent, or Firm*—Lerner, David, Littenberg, Krumholz & Mentlik, LLP

(57) ABSTRACT

In one embodiment a gaitor interface may be used to connect a gaitor to many different types of footwear. The gaitor interface provides a removable attachment between the gaitor and the shoe. One part of the gaitor interface comprises a track that can be mounted along the exterior of the shoe. The track includes a pair of elongated arms that define an interior flex track. Another part of the gaitor interface comprises a connector for attaching to the track. The connector has a bead portion that can be slid into the flex track. The interlock between the bead portion and the flex track provides a releasably secure connection between the gaitor and the shoe. In another embodiment, a convertible shoe having a removable shoe collar is provided. The removable collar may be reversible and may have different linings or covering for the inner and outer surfaces.

34 Claims, 20 Drawing Sheets

U.S. PATENT DOCUMENTS

| | | | | | |
|---|---|---|---|---|---|
| 3,204,346 | A | | 9/1965 | Lockard et al. | |
| 3,263,292 | A | | 8/1966 | Fekete | |
| 4,096,650 | A | | 6/1978 | Seidel | |
| 4,420,893 | A | | 12/1983 | Stephan | |
| 4,461,098 | A | | 7/1984 | Diegelman | |
| 4,575,955 | A | | 3/1986 | Borsoi | |
| 4,586,209 | A | | 5/1986 | Bensley | |
| 4,586,271 | A | | 5/1986 | Maleyko et al. | |
| 4,693,018 | A | | 9/1987 | Maleyko et al. | |
| 4,713,895 | A | | 12/1987 | Vallieres | |
| 4,748,749 | A | | 6/1988 | Colvard | |
| 4,771,553 | A | | 9/1988 | Smithdeal | |
| 4,839,948 | A | * | 6/1989 | Boros | 24/662 |
| 4,856,207 | A | | 8/1989 | Datson | |
| 4,887,369 | A | * | 12/1989 | Bailey et al. | 36/101 |
| 4,958,447 | A | * | 9/1990 | DuPree | 36/101 |
| 4,995,174 | A | | 2/1991 | Hong et al. | |
| 5,065,531 | A | | 11/1991 | Prestridge | |
| 5,068,985 | A | | 12/1991 | Pozzebon | |
| 5,109,614 | A | * | 5/1992 | Curry | 36/100 |
| 5,144,759 | A | | 9/1992 | Mascotte | |
| 5,251,386 | A | | 10/1993 | Diaz | |
| 5,265,350 | A | | 11/1993 | MacPhail | |
| 5,272,822 | A | | 12/1993 | Diaz | |
| 5,337,491 | A | * | 8/1994 | Mascotte | 36/7.1 R |
| 5,491,911 | A | | 2/1996 | Chen | |
| 5,613,250 | A | | 3/1997 | Bell | |
| 5,632,709 | A | | 5/1997 | Walsh | |
| 5,642,573 | A | | 7/1997 | Brown | |
| 5,778,564 | A | * | 7/1998 | Kettner | 36/101 |
| 5,815,833 | A | | 10/1998 | Kuo et al. | |
| 5,815,948 | A | | 10/1998 | Dzielak | |
| 5,845,416 | A | | 12/1998 | Hands | |
| 5,848,484 | A | * | 12/1998 | Dupree et al. | 36/101 |
| 5,887,359 | A | | 3/1999 | Falguere | |
| 5,918,314 | A | | 7/1999 | Moses | |
| 5,983,528 | A | * | 11/1999 | Hartung | 36/15 |
| 5,987,778 | A | | 11/1999 | Stoner | |
| 6,006,447 | A | | 12/1999 | Neal et al. | |
| 6,148,544 | A | | 11/2000 | Keen et al. | |
| 6,263,509 | B1 | | 7/2001 | Bowen | |
| 6,370,692 | B1 | | 4/2002 | Duyn et al. | |
| 6,457,260 | B1 | | 10/2002 | Roelofs | |
| 6,477,788 | B1 | | 11/2002 | Chen | |
| 6,754,983 | B2 | | 6/2004 | Hatfield et al. | |
| 7,058,981 | B2 | | 6/2006 | Clark et al. | |
| 2001/0044991 | A1 | | 11/2001 | Graves | |
| 2002/0066208 | A1 | | 6/2002 | Hall | |
| 2002/0120977 | A1 | | 9/2002 | Smith | |
| 2002/0174565 | A1 | | 11/2002 | Roelofs | |
| 2003/0088996 | A1 | | 5/2003 | Hall | |
| 2003/0093918 | A1 | | 5/2003 | Challe | |
| 2003/0097765 | A1 | | 5/2003 | Chen | |
| 2003/0177664 | A1 | * | 9/2003 | Monassebian | 36/100 |
| 2003/0192205 | A1 | * | 10/2003 | Linens | 36/100 |
| 2004/0055074 | A1 | | 3/2004 | Lin | |
| 2004/0060199 | A1 | | 4/2004 | Sheen | |
| 2004/0128862 | A1 | * | 7/2004 | Flack | 36/100 |
| 2004/0160025 | A1 | | 8/2004 | Liu | |
| 2004/0205982 | A1 | | 10/2004 | Challe | |
| 2006/0112596 | A1 | * | 6/2006 | Chan | 36/100 |

FOREIGN PATENT DOCUMENTS

| | | | |
|---|---|---|---|
| FR | 2215907 | | 8/1974 |
| GB | 475396 | | 11/1937 |
| GB | 524480 | | 8/1940 |
| GB | 708324 | | 5/1954 |
| GB | 944583 | | 12/1963 |
| GB | 971859 | | 10/1964 |
| GB | 2 379 592 | A | 3/2003 |
| GB | 2398833 | | 9/2004 |

* cited by examiner

C-C

D-D

E-E

REMOVABLE SHOE COVERINGS

CROSS-REFERENCE TO RELATED APPLICATIONS

The present application claims the benefit of the filing dates of U.S. Provisional Patent Application No. 60/565,163, filed Apr. 23, 2004, entitled "Removable Shoe Collar", and U.S. Provisional Patent Application No. 60/636,457, filed Dec. 16, 2004, entitled "Gaitor Interface", the entire disclosures of which are hereby expressly incorporated by reference herein.

BACKGROUND OF THE INVENTION

The present invention relates generally to detachable shoe coverings. More particularly, one aspect of the present invention relates to gaitors having track interface connections to articles of footwear. Another aspect of the present invention relates to converting shoes from a low profile to a high profile, and vice versa.

There are countless styles and configurations of footwear that are used in all types of climates and for all sorts of activities. In certain conditions it is desirable to have supplemental articles that connect to the footwear. A gaitor (or gaiter) is a detachable covering for use with shoes or other types of footwear. The gaitor can, for example, keep ice, snow, scree or other debris from getting into the interior of the shoe or from covering the laces or other structures for securing the footwear to the foot.

Gaitors may wrap around the wearer's ankle, up to the knee or any point in between and can attach to the shoe using conventional fasteners such as hook and loop fasteners (e.g., VELCRO® brand hook and loop fasteners), straps, zipper or snaps. Unfortunately, conventional fasteners may suffer from normal wear and tear or from environmental effects. For instance, after repeated connection and release, hook and loop fasteners tend to lose their ability to maintain a secure connection. Straps can freeze in cold weather and may become too stiff to wrap around the shoe and secure the gaitor. Buttons can break, button holes can become fouled with snow, ice, debris, etc., and the act of buttoning can be difficult in cold weather. Snaps and zippers tend to easily clog with snow, ice, debris, etc., making it very difficult for the user to fasten or unfasten the gaitor. Therefore, a need exists for an improved interface between the gaitor and the article of footwear that does not wear down and can function in extreme environmental conditions. Furthermore, there is a need for an interface that provides easy and fast attachment and removal.

As mentioned above, the present invention also relates to converting shoes between a low profile and a high profile. Shoes, and particularly boots such as work boots and hiking boots, can be designed to have either a low profile (such as "chukka" style boots) that do not cover the ankle or do not cover all of the ankle, or a high profile, extending around the ankle portion or higher of the shoe. High profile shoes, typically having a collar at the heel of the shoe of six inches or more in height, have the advantage of providing protection and support for the ankle of the wearer. But such added protection comes at the expense of decreased mobility and flexibility. Low profile shoes have increased mobility at the ankle. However, low profile shoes leave the ankle or the upper portion of the ankle unsupported and unshielded from the elements, which can be a disadvantage to the wearer in certain circumstances.

It would be highly desirable for a single shoe to incorporate all of the advantages of both low profile and high profile shoes. Unfortunately, however, no such combination of features has yet been developed in a single shoe. Alternatively, it would be desirable to provide a convenient method for converting a low profile shoe into a high profile shoe to allow the wearer to select the particular style of shoes to use without being forced to purchase two pairs of boots. Once again, however, no such method or footwear has yet been developed. Accordingly, it is desirable to provide the consumer with a simple and expedient method for converting a low profile shoe into a high profile shoe at a reasonable cost or vice versa.

SUMMARY OF THE INVENTION

In a preferred embodiment, the present invention provides track interfaces for connecting different types of gaitors to any type of shoe. As used herein, the term "shoe" is intended to encompass a variety of footwear including, but not limited to, casual shoes, dress shoes, boots, sneakers, athletic shoes, moccasins, sandals and the like. Each track interface comprises two parts that releasably interconnect. The first part is a track that includes a pair of arms. The arms define an interior flex track. The second part is a connector having a bead at one end thereof. The bead is configured to be insertable into the flex track. The bead is desirably an elongated bead that is at least as long as the flex track.

In operation, it is preferable to slide the bead into the flex track. A locking post, stopping member or other structure can be included along with the track to prevent the bead from unintentionally sliding out of the flex track. Depending upon the materials used for the track and the connector, it may be possible to pull or rip the bead away from the flex track without sliding it out. However, it is preferable to construct the track and the connector from rigid or semi-rigid materials, and, more preferably, to disengage the connector from the track by sliding the bead out from the flex track.

The track interface will not lose its ability to maintain a secure connection between the gaitor and the shoe. The track interface will not cease to function in cold weather and will not become too stiff to engage the connector to the track to secure the gaitor. Should snow, ice, debris, etc., become lodged within the flex track, the wearer can easily knock the unwanted material out of the flex track without impairing the function of the connector and the track. Thus, the wearer can easily fasten or unfasten the gaitor from the shoe in all types of adverse conditions.

Preferably, the track is stitched or otherwise fastened to the shoe, and the connector is stitched or otherwise fastened to the gaitor, for example along a bottom edge of the gaitor. The track may be placed nearly anywhere along the exterior of the shoe, with the possible exception of the bottom of the outsole or tread. Multiple tracks may be placed at various points on the shoe, preferably with a first track on the medial side of the shoe and a second track on the lateral side of the shoe. Supplemental fasteners may be used to attach the gaitor to the shoe at places where it is either difficult to place a track or connector, or at places where it is desirable to have an additional means of securing the gaitor.

In another preferred embodiment, a gaitor interface for releasably connecting a gaitor to a shoe is provided. The gaitor interface comprises a track and a connector. The track includes a pair of arms and a flange. The pair of arms has upper ends curved towards one another defining an interior region of the track. The flange is adapted for attachment to a surface of the shoe. The connector comprises an attachment section and a connection section. The attachment section is attachable to a surface of the gaitor. The connection section is adapted to be slidably inserted into and removed from the interior region of the track.

In an alternative, the connection section is substantially perpendicular to the attachment section. In another alternative, the connection section includes an elongated bead disposed along an edge thereof, and the elongated bead is slidably insertable into the interior region of the track. In a further alternative, the track also includes a stopping member that is disposed on the flange opposite an opening into the interior region of the track. Thus, when the connector is received within the interior region, the stopping member prevents accidental removal of the connector.

In accordance with another embodiment, a shoe is provided, which includes an outsole for contacting the ground, an upper connected to the outsole, and a pair of tracks disposed on the shoe. The tracks each include an elongated pathway adapted to slidably receive a gaitor. In an alternative, the tracks each comprise a pair of arms and a flange. The pair of arms have upper ends curved towards one another to defining the elongated pathway, and the flange is adapted for attachment to a shoe surface. In this case, at least one of the tracks may further include a hinge disposed on the flange opposite an opening into the elongated pathway of the track. Here, the gaitor includes a connector that is received within the elongated pathway, and when the gaitor connector is received within the elongated pathway the hinge prevents removal of the gaitor connector.

In another example, the upper includes a collar region. Here, a first one of the tracks can be disposed on a medial side of the collar region, and a second one of the tracks can be disposed on a lateral side of the collar region. In yet another example, the upper includes a closure region. In this case, a first one of the tracks is disposed on a medial side of the closure region, and a second one of the tracks is disposed on a lateral side of the closure region. In another example, a first one of the tracks is disposed on a medial side of the outsole, and a second one of the tracks is disposed on a lateral side of the outsole. In a further example, the shoe additionally comprises a midsole between the upper and the outsole. In this case, a first one of the tracks may be disposed on a medial side of the midsole and a second one of the tracks is disposed on a lateral side of the midsole.

In accordance with yet another embodiment, a shoe is provided, which comprises a gaitor, an outsole, an upper and a pair of receptacles. The gaitor is adapted to cover at least a portion of the shoe. The gaitor includes a covering and a pair of connectors. The outsole is adapted to contact the ground, and the upper is connected to the outsole. The pair of receptacles can be disposed on the upper or the outsole. The receptacles each include an elongated pathway adapted to slidably receive one of the connectors.

In one alternative, each connector comprises an attachment section and a connection section. In this case, the attachment section is attachable to the gaitor covering, and the connection section is slidably insertable into a respective one of the elongated pathways. In another alternative, the connection section is substantially perpendicular to the attachment section. In this case, the connection section desirably includes an elongated bead disposed along an edge thereof, and the elongated bead is slidably insertable into the respective elongated pathway. Here, at least one of the receptacles may further include a flexible stopper disposed opposite an opening into the elongated pathway. When the elongated bead of a selected one of the connectors is received within the interior region, the flexible stopper prevents accidental disengagement of the selected connector from the receptacle.

In another example, both of the receptacles are disposed on an exterior surface of the upper. In a further example, both of the receptacles are disposed on an exterior surface of the outsole. In an additional example, the outsole includes a midsole connected to the upper, and at least one of the receptacles is disposed on the midsole. In another example, the covering of the gaitor includes a stretchable gore.

In another preferred embodiment, the present invention provides a removable shoe collar or gaitor for converting a low profile shoe into a high profile shoe, and a method for accomplishing this result. The collar can be made of a flexible material, such as materials commonly used, for example wovens (such as canvas), non wovens (such as synthetic leather), and/or knitted fabrics (such as a polyester/nylon mesh, leather or plastic, and has a contour adapted to be fitted over the outer surfaces of the low profile shoe. The shoe is provided with fasteners on at least the side sections thereof for securing the removable collar, and the collar has complementary fasteners on the base portion thereof for engaging the fasteners on the shoe. The conversion of the low profile shoe into a high profile shoe can thereby be easily and rapidly accomplished simply by engaging the complementary fasteners with minimal effort.

Fasteners suitable for use in the present invention include buttons, adapted to be fitted in button holes, zippers, VELCRO, strings, snaps and/or the track-based slide fasteners described herein. The collar is generally configured to have a heel section and a midfoot section, with the midfoot section portion being somewhat more extended in length as compared to the heel section.

The collar can be fastened together using a variety of fastening techniques. One such technique involves the use of eyelets positioned down the front of the collar on the top of the shoe. This is commonly referred to as the throat of a shoe. The eyelets are arranged and configured to receive a lace, and a tongue can also be disposed under the lace. In this embodiment, the laced portion of the collar creates the visual appearance of a normal high profile shoe. The laces also serve a functional utility of securing the collar and shoe to the foot of the wearer.

In one embodiment, the collar laces can be used to fasten and secure the collar to the laced section of the shoe. This can be accomplished by utilizing hooks mounted on the laced section of the shoe for attachment of the collar laces. The collar can also be closed using a variety of fastening techniques other than laces, such as by the use of zippers, snaps, buttons, VELCRO closures and the like.

In another embodiment, the collar can contain a lining of a water or solvent repellent material. The water repellent or hydrophobic material is preferably expanded polytetrafluroethylene or PTFE, a material commonly sold under the mark GORE-TEX® In this embodiment, the boot is suitable for foul weather conditions, such as for use in snow and rain, where the ankle of the wearer is protected from the environment by the collar. The collar can also contain insulation material for protecting the ankle of the wearer in extreme cold weather conditions.

Preferably, the collar is reversible to provide additional functional and aesthetic value to the wearer, but it need not be. For instance, in a non-reversible configuration, the inside of the collar can incorporate water repellent material, while the outside of the collar can include an aesthetic design. Alternatively, both the inside and outside of the collar can include designs which the wearer and select at his or her discretion. It will be appreciated that a reversible collar must include shoe fasteners on both the inside and outside surfaces of the collar, unless the track-based connection system is employed. It will also be appreciated that a shoe can be sold with multiple collars to provide a variety of functional and aesthetic choices to the wearer. In the method of this invention, the wearer installs the collar by engaging the complementary fasteners on the side of the shoe and on the collar, such as at the based of the collar. Once secured in place, the wearer can lace the collar to secure the shoe to the foot and ankle.

In accordance with a further embodiment, a shoe is provided, which comprises a gaitor, an outsole, an upper and a pair of receptacles. The gaitor is adapted to cover at least a portion of the shoe. The gaitor includes a covering and a pair of connectors. The outsole is adapted to contact the ground, and the upper is connected to the outsole. The pair of receptacles can be disposed on the upper or the outsole. The receptacles each include an elongated pathway adapted to slidably receive one of the connectors. The covering of the gaitor preferably includes a releasable fastening mechanism to fasten a first region of the covering to a second region of the covering. The releasable fastening mechanism desirably comprises lacing and eyelets.

In an alternative, a first surface of the covering comprises a first material and a second surface of the covering comprises a second material. The gaitor may also be reversible. The first surface may include a hydrophobic layer and the second surface may include an insulating layer. The hydrophobic layer preferably comprises a waterproof coating. In a further alternative, the first and second surfaces provide different appearances. In yet another alternative, the receptacles each comprise a track including a pair of arms and a flange. In this case, the pair of arms have inward curving upper ends defining the elongated pathway, and the flange is adapted for attachment to a surface of the shoe.

In accordance with yet another embodiment, a gaitor for covering at least a portion of a shoe is provided. The gaitor comprises a covering and a pair of elongated connectors. A first one of the elongated connectors is disposed along a medial side of the covering, and a second one of the elongated connectors is disposed along a lateral side of the covering. The connectors are adapted to slidably engage an elongated track of the shoe.

In an example, each connector comprises an attachment section and a connection section. The attachment section is attachable to a portion of the covering. The connection section is adapted to be slidably inserted into and removed from the elongated track of the shoe. In this case, the connection section is preferably substantially perpendicular to the attachment section. In another example, the connection section includes an elongated bead disposed along an edge thereof, and the elongated bead is slidably insertable into the elongated track. In a further alternative, the connection section of each connector comprises a bendable material.

In accordance with yet another embodiment, a method of connecting a gaitor to a shoe is provided. The gaitor includes an elongated connection member and the shoe includes a track. The method comprises aligning the elongated connection member with the track, and sliding the elongated connection member into the track until at least 50% of the elongated connection member is received within the track. In an alternative, the method further comprises disconnecting the gaitor from the shoe by sliding the elongated connection member out of the track. In another alternative, the method further comprises disconnecting the gaitor from the shoe by pulling an end of the elongated connection member substantially perpendicularly away from the track.

DETAILED DESCRIPTION

In describing the preferred embodiments of the invention illustrated in the appended drawings, specific terminology will be used for the sake of clarity. However, the invention is not intended to be limited to the specific terms used, and it is to be understood that each specific term includes all technical equivalents that operate in a similar manner to accomplish a similar purpose.

Figure 1A:
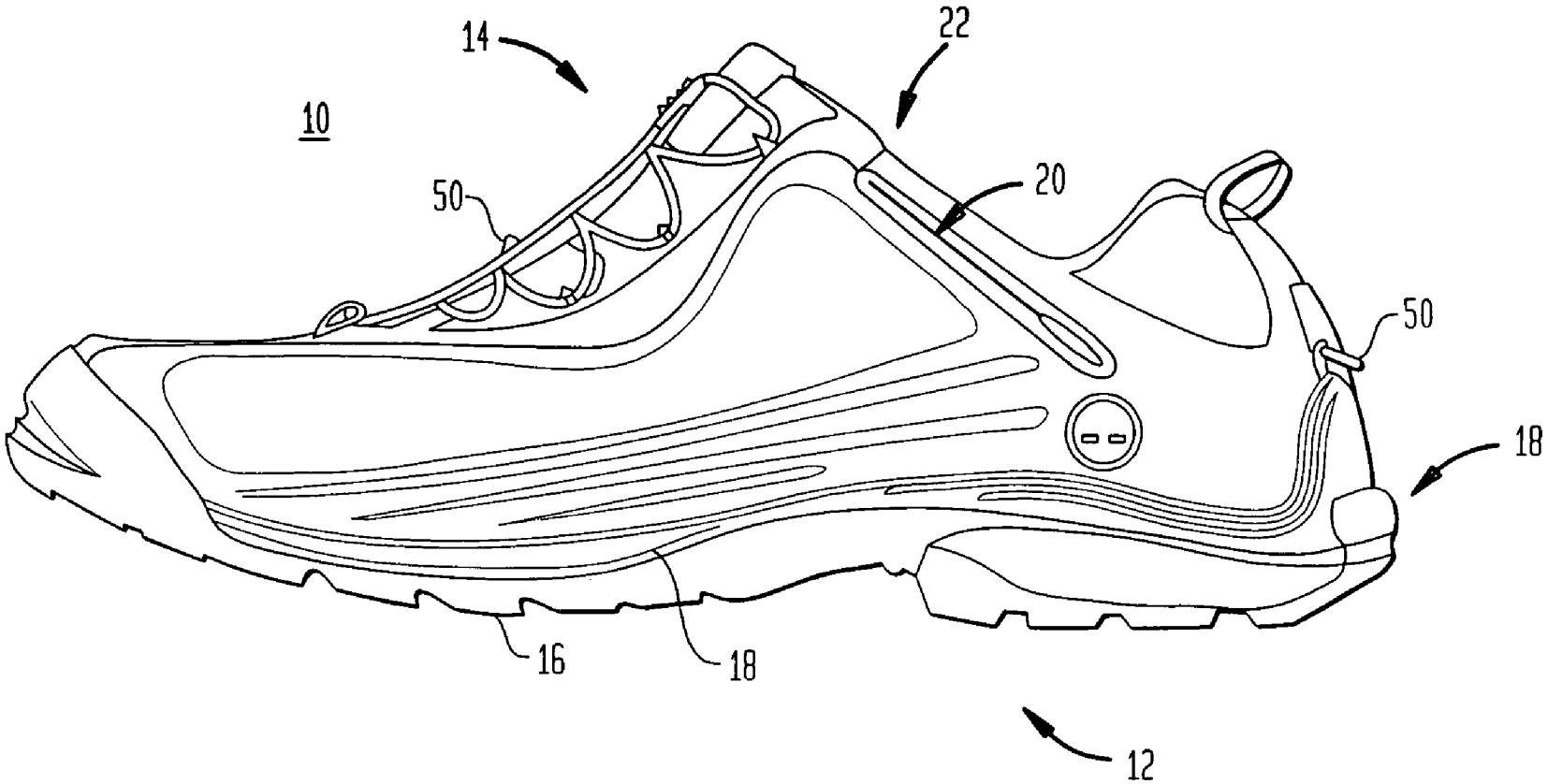
FIGS. 1(*a*)-(*b*) illustrate a shoe and a gaitor for use in accordance with aspects of the present invention.
Figure 1B:
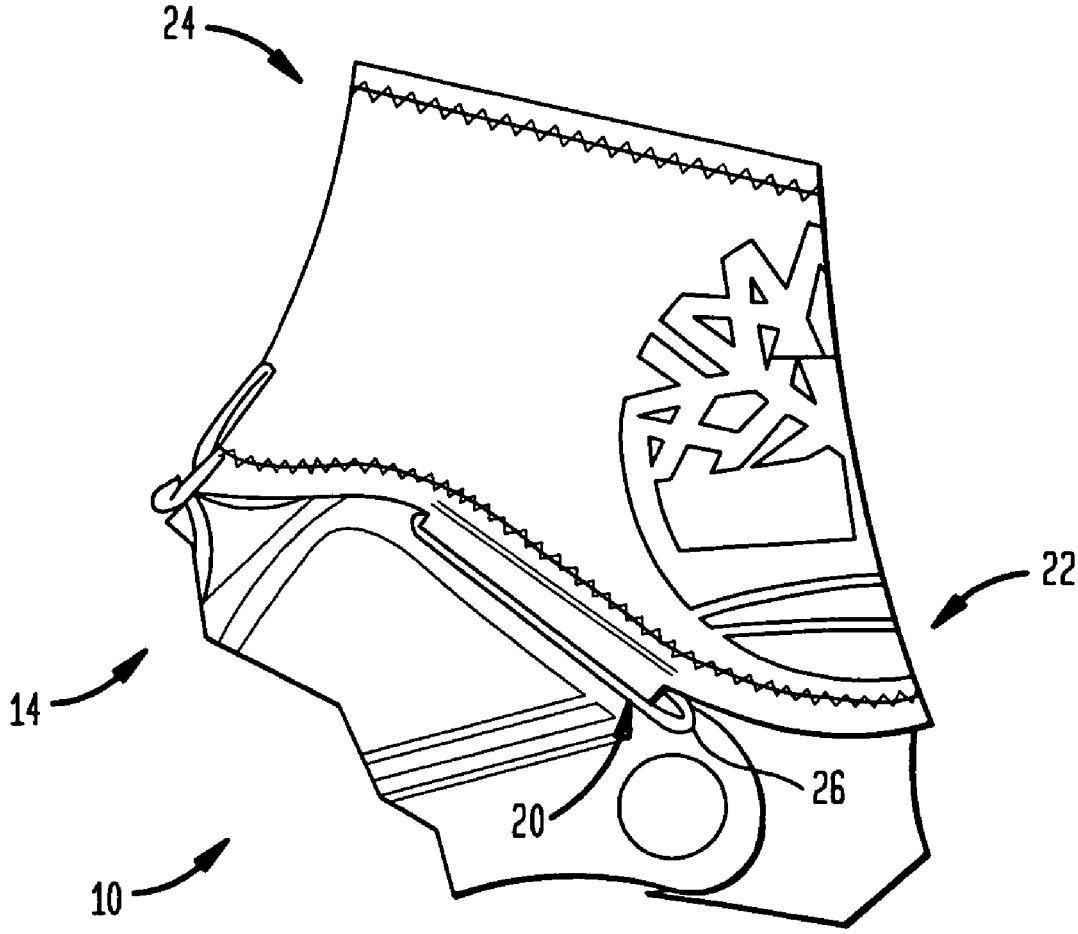

FIG. 1(*a*) illustrates an exemplary shoe 10 suitable for use with gaitor interfaces in accordance with the present invention. The shoe 10 may be any type or style of footwear, including, but not limited to, athletic shoes such as sneakers, work boots, hiking boots, winter boots, etc. Here, the exemplary shoe is shown having an outsole 12 and an upper 14. The outsole 12 may include a tread 16 on the bottom thereof. As shown, a region 18 connects the outsole 12 to the upper 14. The region 18 may be integral with the outsole 12, or may comprise a separate midsole, a lasting board, etc. Alternatively, the outsole 12 and the upper 14 may be directly connected to one another or may be integrally formed as a single piece.

The shoe 10 is illustrated as including a track 20. The track 20 is adapted to receive a gaitor (not shown). While the side view of FIG. 1(*a*) shows only a single track 20, the shoe 10 may have two or more tracks 20. The track 20 is shown along the exterior of a collar or foot receiving region 22 of the upper 14. The collar region 22 includes, but is not limited to, the top portion of the upper that includes an opening for receiving the wearer's foot. However, as will be shown in more detail below, the track(s) 20 may be placed in many different positions along the outside of the shoe 10. In fact, the track(s) 20 may be placed anywhere along the exterior of the shoe 10 with the exception of the bottom of the outsole 12 such as the tread 16. Optionally, the track 20 may be placed along the interior of the collar region 22.

FIG. 1(*b*) illustrates a top portion of the upper 14 in an alternative shoe configuration, as well as a gaitor 24 attached thereto. The gaitor 24 includes a connector 26 that interconnects with the track 20. The size, shape and other dimensions of the gaitor 24 may vary depending upon the function and placement of the gaitor 24. In the example of FIG. 1(*b*), the gaitor 24 covers the top of the collar region 22, as well as the ankle of the wearer. When attached to the shoe 10, the back of the gaitor 24 may extend approximately 130 mm from top to bottom. However, as noted above, the dimensions of the gaitor 24 will vary depending upon its function and where it is placed on an article of footwear. In some alternatives, the gaitor 24 extends above the ankle and down to the point of attachment on the upper 14 or elsewhere on the shoe 10. In one example, the gaitor 24 may have a height of at least 40 mm. In another example, the gaitor 24 may have a height of less than 250 mm. As shown in FIG. 1(*b*), an elasticized screen print logo or other image may be placed on a portion of the gaitor 24.

The gaitor 24 may be fabricated using a wide variety of materials. By way of example only, the gaitor 24 may comprise leather, mesh, LYCRA® brand spandex synthetic fibers and filaments, nylon (such as ripstop nylon or urethane coated nylon), neoprene, laminated fabric, spandex, waterproof fabrics (such as GORE-TEX® brand waterproof fabrics), or any combination thereof. The gaitor 24 may also include an insulating material, such as fleece, which may be used alone or in combination with any of the other materials discussed above.

Figure 2A:
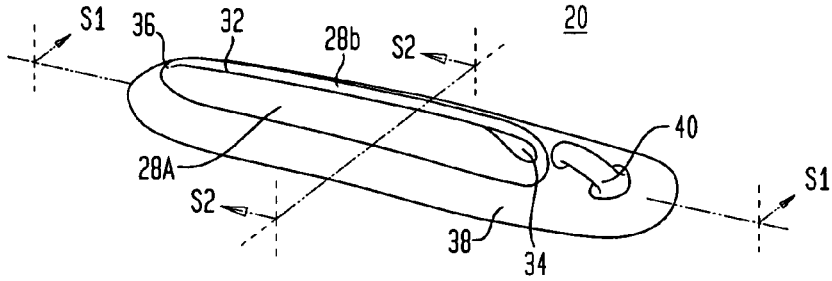
FIGS. 2(*a*)-(*c*) illustrate a track for use in accordance with aspects of the present invention.
Figure 2B:
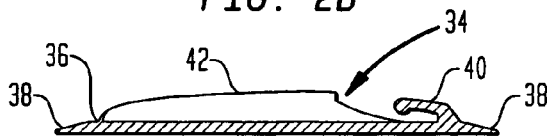
Figure 2C:
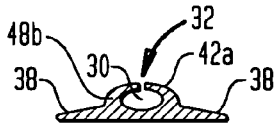

FIGS. 2(*a*)-(*c*) illustrate the track 20 in more detail. As seen in the perspective view of FIG. 2(*a*), the track preferably includes a pair of arms 28*a,b*. The arms 28*a,b* are preferably curved towards one another to define a central opening, cavity, receptacle or "flex track" 30 in the interior of the track 20, and a top slit or opening 32 running between the upper portions of the pair of arms 28*a,b*.

The flex track 30 desirably runs substantially the length of the pair of arms 28*a,b*. Preferably, the flex track 30 runs at least 50% of the length of the pair of arms 28*a,b*. More preferably, the flex track 30 runs at least 75% of the length of the pair of arms 28*a,b*. An opening 34 is preferably provided at a first end of the pair of arms 28*a,b* and a stop, post or bumper 36 is preferably provided at a second end thereof. The track 20 desirably also includes a flange or other attachment structure 38. The flange 38 may be used to stitch or otherwise affix the track 20 to the shoe 10. As shown in FIG. 2(*a*), the flange 38 may circumscribe the track 20. Alternatively, the flange 38 may comprise one or more flange sections that do not circumscribe the track 20. Preferably, the attachment structure or flange 38 provides sufficient surface area to securely attach the flex track 30 to the upper 14 or elsewhere on the shoe 10. Optionally, the track 20 may also include a locking post 40, hinge or other structure to prevent the connector 26 from unintentionally detaching from the flex track 30.

FIG. 2(*b*) illustrates a cross-sectional view of the track 20 along section line S1-S1 of FIG. 2(*a*). Interior sidewalls 42*a,b* of the arms 28*a,b* may be textured, for example to provide a frictional surface. The textured interior sidewalls 42*a,b* help prevent the connector 26 from easily detaching from within the flex track 30.

FIG. 2(*c*) illustrates a cross-sectional view of the track 20 along section line S2-S2 of FIG. 2(*a*). As shown in FIG. 2(*c*), the cross-section of the flex track 30 is preferably substantially circular or oval shaped. The top slit or opening 32 is preferably substantially narrower than the width of flex track 30. Preferably, the top slit 32 is between 0.25 mm and 1.5 mm wide, although it may be wider or narrower. More preferably, the top slit 32 is on the order of 1.0 mm wide. However, as will be explained below, the top slit 32 may widen as the connector 26 is attached to the track 20 and may narrow as the connector is detached from the track 20.

Figure 3A:
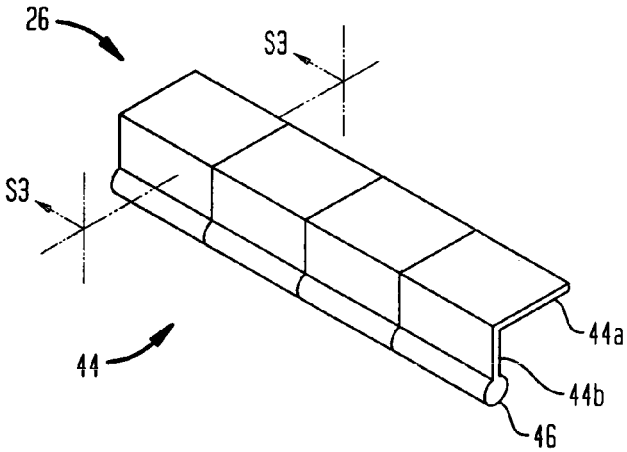
FIGS. 3(*a*)-(*b*) illustrate a connector for attaching to the track of FIGS. 2(*a*)-(*c*) in accordance with aspects of the present invention.
Figure 3B:
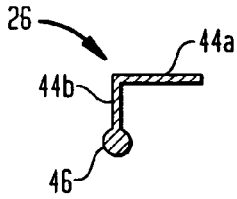
Figure 4B:
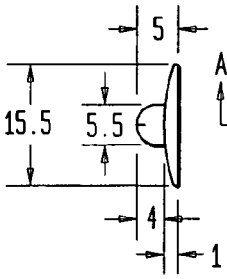
FIGS. 4(*a*)-(*i*) illustrate features of the track of FIGS. 2(*a*)-(*c*).
Figure 4A:
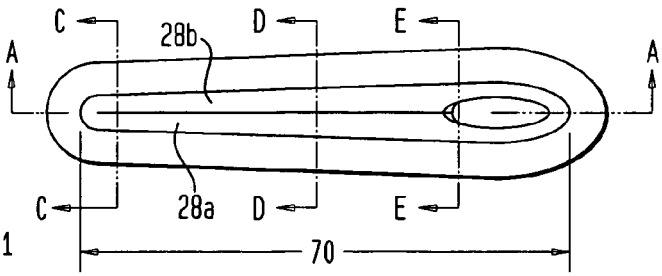
Figure 4C:
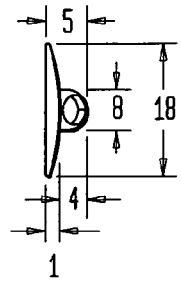
Figure 4D:
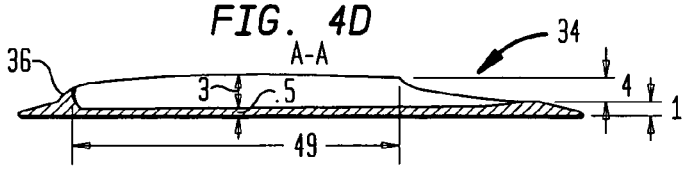
Figure 4E:
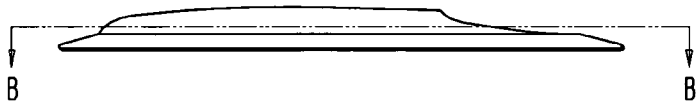
Figure 4F:
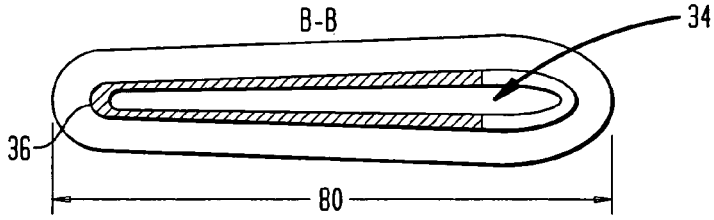
Figure 4G:
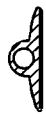
Figure 4H:
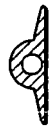
Figure 4I:
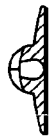

FIG. 3(*a*) illustrates the connector 26 in detail. The connector 26 preferably comprises an L-shaped or otherwise angled member 44, which includes an attachment section 44*a* and a connection section 44*b*. The attachment section 44*a* can be sewn or otherwise attached to a surface of the gaitor 24 (not shown). The connection section 44*b* attaches along one side to the attachment section 44*a*. Along the other side of the connection section 44*b* is an engagement member such as a rounded edge or bead 46. The bead 46 is preferably an elongated bead 46 that extends the length of the connection section 44*b*, or at least of sufficient length to stabilize the connection section 44*a*. FIG. 3(*b*) illustrates a cross-sectional view of the connector 26 along section line S3-S3 of FIG. 3(*a*).

As seen in FIG. 3(*b*), the elongated bead 46 desirably has a rounded or oval cross-section that is adapted to fit within the flex track 30. However, the elongated bead 46 or other engagement member may have any other geometrical shape, such as a square, triangle, diamond or T-shape. The rounded or oval cross-section is preferable because such a configuration is easy to insert and remove from the flex track 30. Furthermore, during wear, the shoe and the accompanying track 20 and/or the connector 26 may flex. The flexing may cause the bead 46 to bend. The rounded/oval cross-section permits the bead 46 to give slightly during flexing. In addition, the rounded/oval shape does not have sharp corners, thus, should the flex track 30 be relatively long and/or be contoured to conform to the shoe, the bead 46 can easily be inserted and removed. Alternatively, the connector 26 does not have an L-shaped member 44, but rather a single straight member 44' (see FIGS. 6(*a*)-(*b*)) having the elongated bead 46 at a first end thereof and a connection to the gaitor 24 at the other end thereof.

FIGS. 4(*a*)-(*i*) illustrate dimensions in millimeters for a preferred embodiment of the track 20. As seen in the top view of FIG. 4(*a*), the overall length in the preferred embodiment is approximately 80 mm, although the overall length may be shorter or longer. For example, the overall length may be less than 30 mm, may extend 200 mm or more, or anywhere in between depending upon the shoe type and where the track 20 is placed on the shoe. The arms 28*a,b* preferably extend approximately 70 mm in length, although the arm length may be shorter or longer. For example, the arm length may be less than 20 mm, may extend 180 mm or more, or anywhere in between, depending upon the shoe type and where the track 20 is placed on the shoe. As shown in FIG. 4(*a*), the exterior surfaces of the arms 28*a,b* are desirably slightly non-parallel, tapering inwards from the opening 34 towards the stop 36.

As seen in the front and back views of FIGS. 4(*b*)-(*c*), respectively, the exterior width of the arms 28*a,b* is approximately 8 mm near the opening 34, narrowing to approximately 5.5 mm near the stop 36. However, the exterior width may be at least 3 mm in one alternative, less than 25 mm in another alternative, etc. FIGS. 4(*b*)-(*c*) also show that the overall height of the track 20 is approximately 5 mm, although the height may be higher or lower, for instance at least 2 mm or less than 15 mm. The thickness of the flange 38 is preferably approximately 1 mm, although it may be as thin as 0.25 mm or up to 5 mm thick or more. The height of the arms 28*a,b* is approximately 4 mm, although there is no required minimum or maximum height. The overall width of the track 20 is approximately 18 mm near the end of the track 20 adjacent to the opening 34, and the overall width of the track 20 is approximately 15.5 mm near the end adjacent to the stop 36. Of course, it should be understood that all of these dimensions are preferable, and may vary depending upon what size and style of footwear the track is used in conjunction with.

FIG. 4(*d*) illustrates a cross-sectional view of the track 20 along section line A-A of FIG. 4(*a*). As seen in FIG. 4(*d*), the flex track 30 is approximately 49 mm in length from the opening 34 to the interior surface of the stop 36.

FIG. 4(*f*) illustrates a cross-sectional view of the track 20 along section line B-B of the side view of FIG. 4(*e*). As can be seen in FIG. 4(*f*), while the exterior surfaces of the arms 28*a,b* preferably taper from the end adjacent to the opening 34 toward the end adjacent to the stop 36, the interior surfaces of the arms 28*a,b* are preferably substantially parallel. FIGS. 4(*g*)-(*i*) illustrate cross-sectional views of the track 20 along section lines C-C, D-D and E-E, respectively, of FIG. 4 (*a*). The flex track 30 is desirably substantially circular or slightly oval as seen in each of the views of FIGS. 4(*g*)-(*i*). The cross-sectional diameter of the flex track 30 is preferably approximately 3 mm along the length of the flex track 30.

Alternatively, the cross-sectional diameter of the flex track 30 may taper from the area adjacent to the opening 34 toward the end adjacent to the stop 36. In one example of this alternative, the cross-sectional diameter of the flex track 30 may preferably taper from about 3-4 mm from the area adjacent to the opening 34 to about 2-3 mm in the area adjacent to the stop 36. Whether the flex track 30 tapers or not, it is desirable for the bead 46 to fit snugly within the flex track 30. This provides for proper securing of the gaitor 24 to the upper 14 or to another part of the shoe 10. In another alternative, there may be a locking or retention mechanism (not shown) within the flex track 30 near or adjacent to the stop 36. The locking or retention mechanism can be used alone or in combination with the locking post 40 to prevent the bead 46 from accidentally pulling out of the flex track 30. In a further alternative, the flex track 30 may include one or more ridges or protrusions (not shown) along the interior sidewalls of the arms 28*a,b*. The ridges/protrusions can be used to provide additional friction and/or to act as a retention means to prevent the bead 46 from accidentally pulling out of the flex track 30. The ridges/protrusions can be used alone, or in combination with the locking/retention mechanism and/or the locking post 40.

Figure 5:
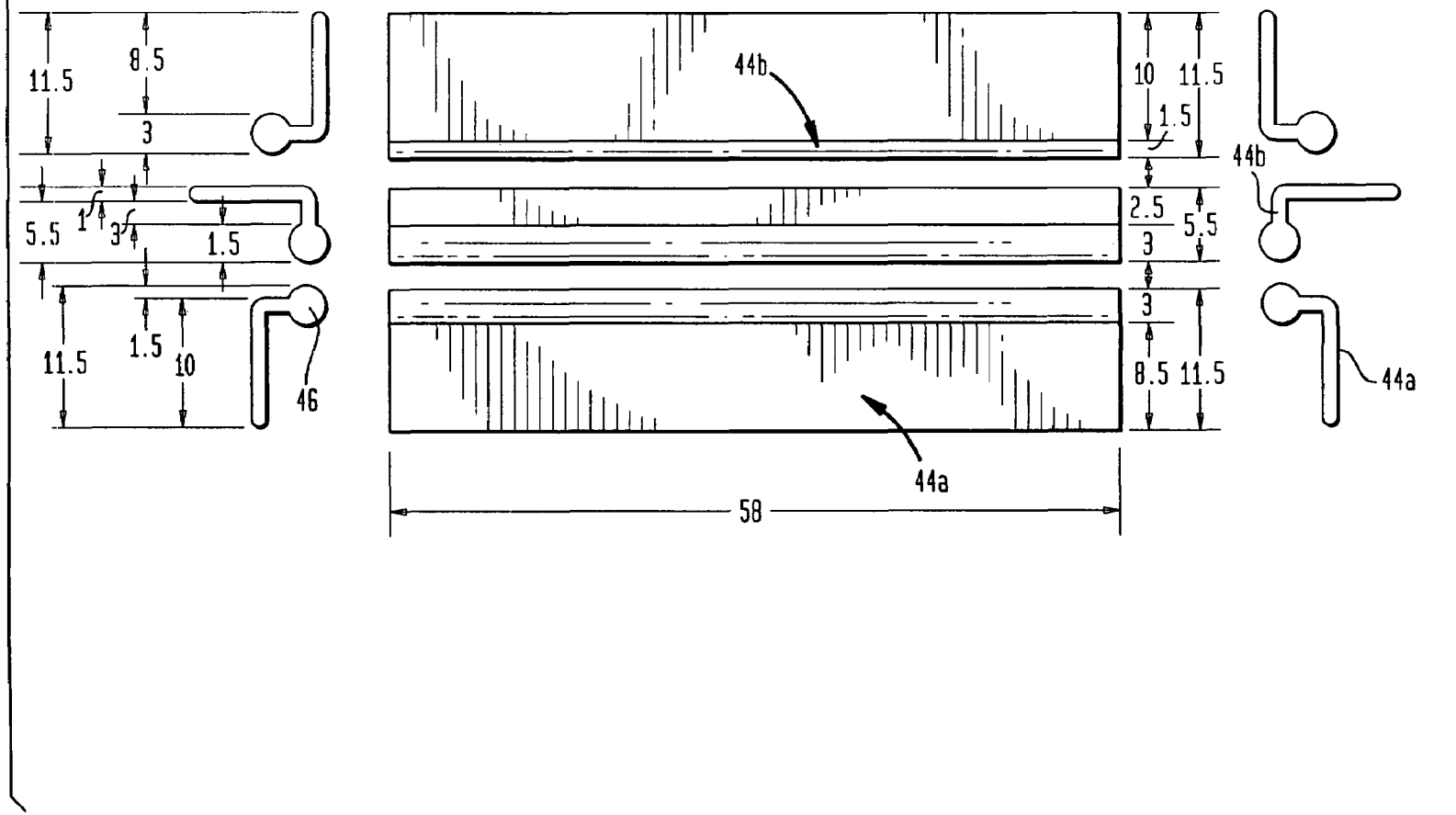
FIG. 5 illustrates features of the connector of FIGS. 3(*a*)-(*b*).

FIG. 5 illustrates dimensions in millimeters for a preferred embodiment of the connector 26. As seen in the views in FIG. 5, the overall length in the preferred embodiment is approximately 58 mm. The attachment section 44*a* is preferably about 10 mm high. The thickness of the attachment section 44*a* is preferably about 1 mm. The connection section 44*b* is preferably about 2.5 mm high. The thickness of the connection section 44*b* is preferably about 1 mm. More preferably, the thickness of the connection section 44*b* is approximately the width of the top slit 32. The diameter of the bead 46 is preferably about 3 mm. More preferably, the diameter of the bead 46 is approximately the diameter of the flex track 30.

Regardless of the exact dimensions in this preferred embodiment, the overall length of the connector 26, in particular the overall length of the elongated bead 26, is preferably at least as long as the length of the flex track 30. More preferably, the overall length of the elongated bead 26 is between 1.0 and 1.25 times the length of the flex track 30. In alternative examples, the elongated bead 26 may be replaced by two or more discrete bead segments disposed along the connection section 44*b* or the straight member 44'. In such examples, the overall length of the connection section 44*b* or the straight member 44' is preferably between 1.0 and 1.25 times the length of the flex track 30. Furthermore, at least one discrete bead segment is preferably placed at either end of the connection section 44*b* or the straight member 44'.

Figure 6A:
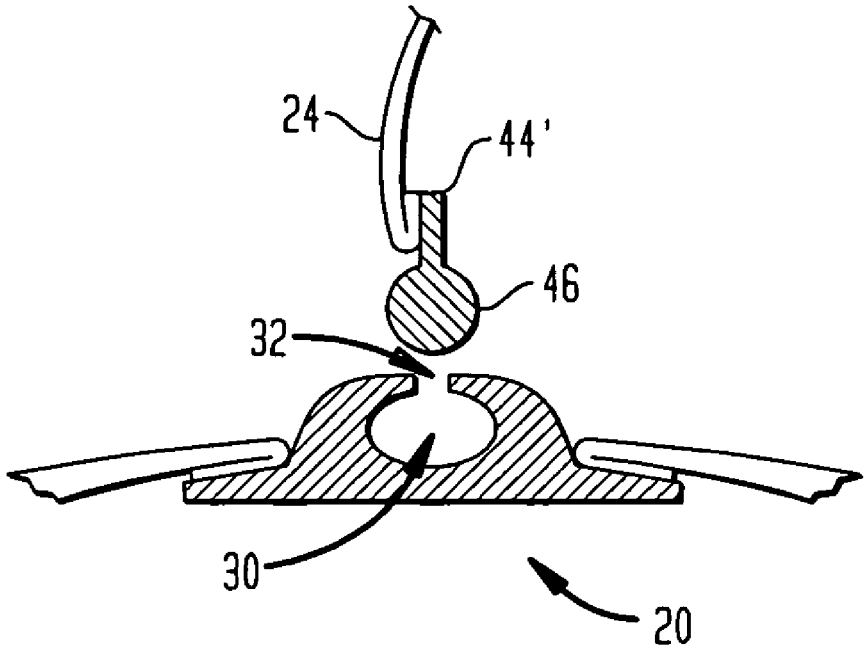
FIGS. 6(*a*)-(*b*) illustrate cross-sectional views of the track and the connector in accordance with aspects of the present invention.
Figure 6B:
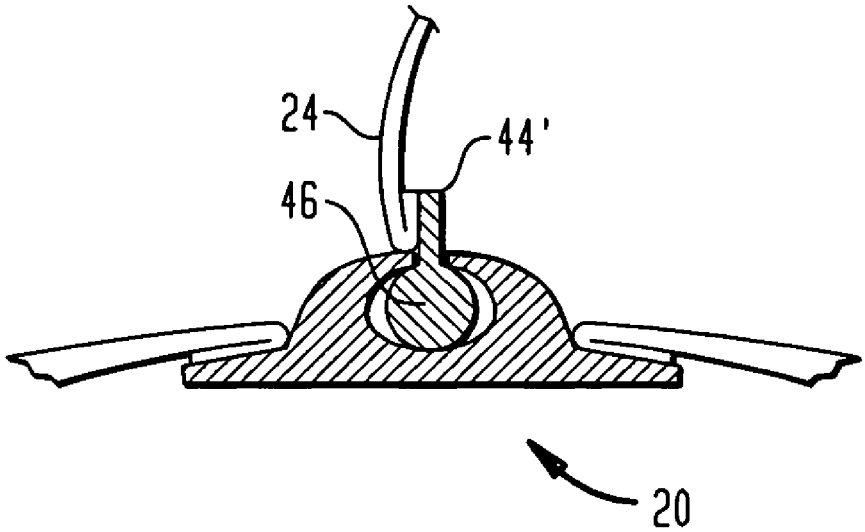
Figure 7A:
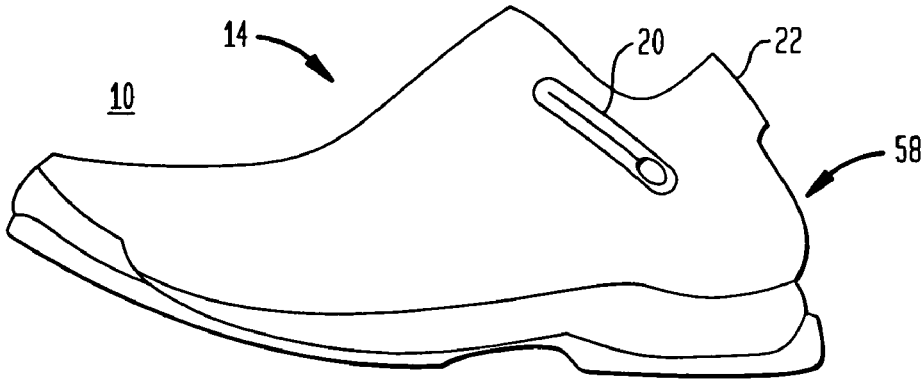
FIGS. 7(*a*)-(*d*) illustrate a gaitor connecting to a collar region of a shoe in accordance with aspects of the present invention.
Figure 7B:
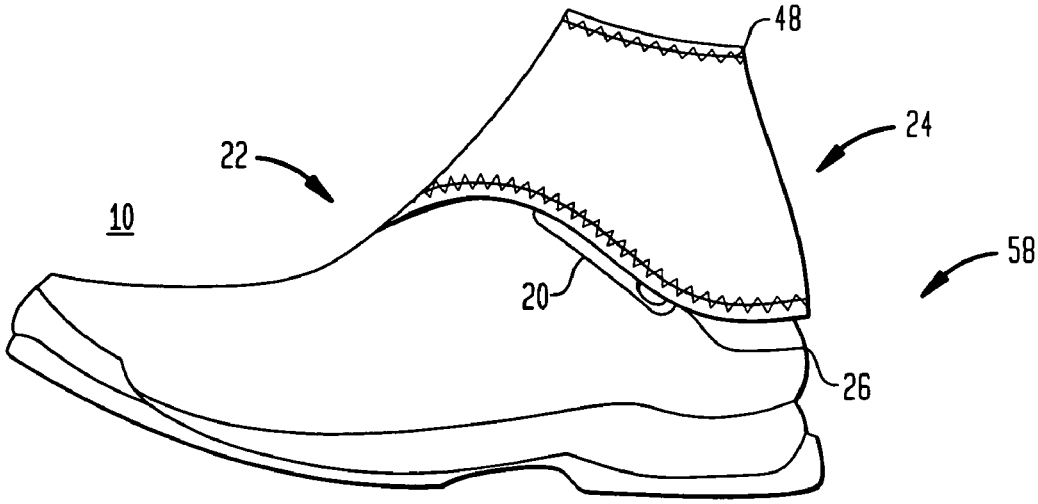
Figure 7C:
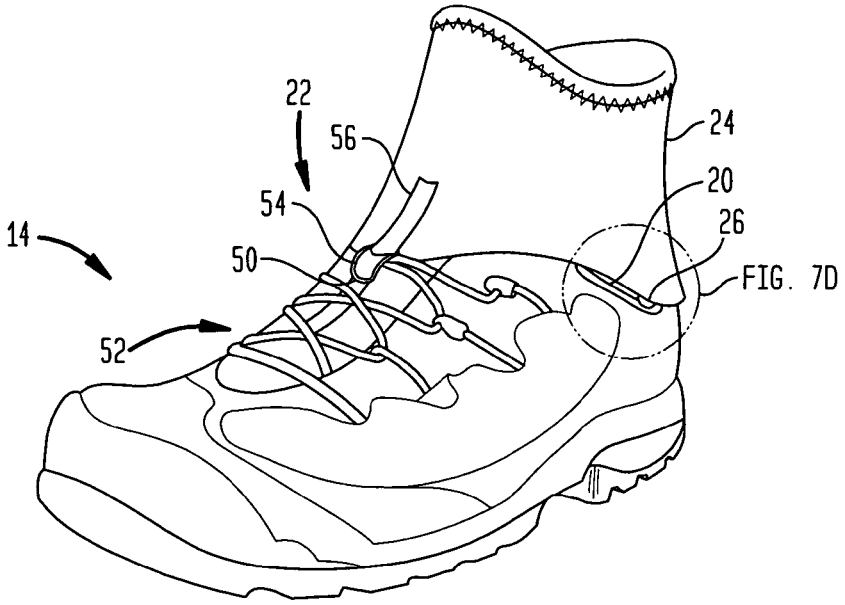
Figure 7D:
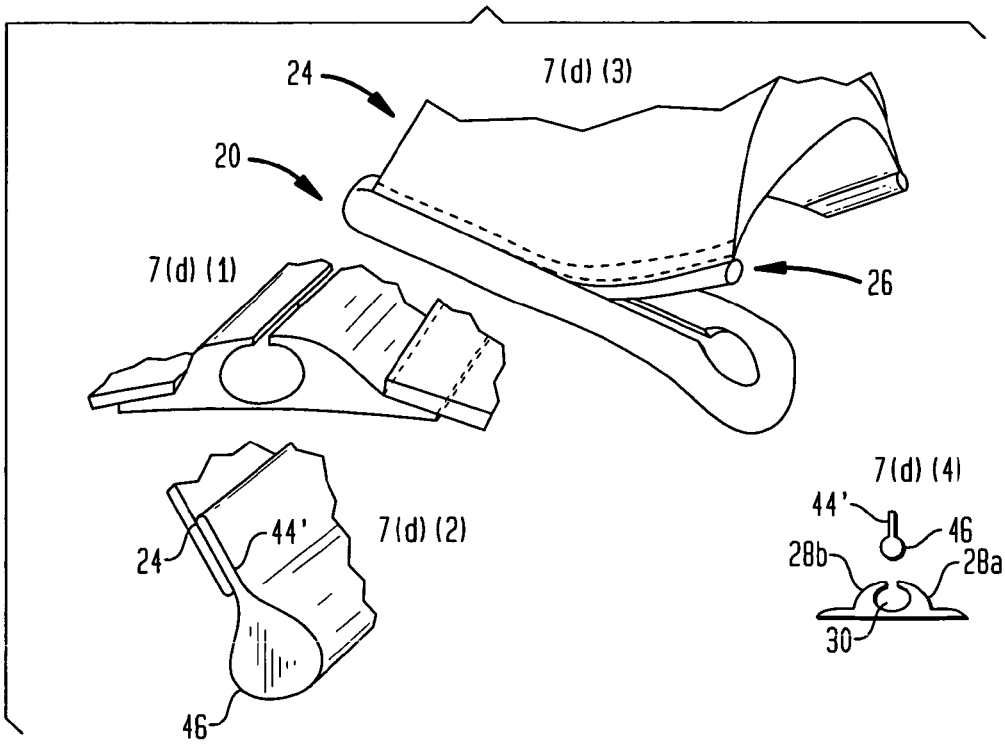

FIGS. 6(*a*)-(*b*) illustrate the connector 26 prior to and after assembly with the track 20, respectively. As discussed above, the thickness of the connection section 44*b* or the thickness of the straight member 44' is preferably the approximate width of the top slit 32, as seen in FIG. 6(*a*). Similarly, the cross-sectional shape of the bead 46 is preferably approximately the cross-sectional shape of the flex track 30. These matching or mating dimensions (the thickness of the connection section 44*b* or the straight member 44' with the width of the top slit 32, as well as the cross-sectional shape of the bead 46 with the cross-sectional shape of the flex track 30) enable a secure, releasable connection between the connector 26 and the track 20.

Furthermore, the narrow width of the top slit or opening 32 helps to prevent ice, snow, scree or other debris from entering the flex track 30 and clogging it. Even should debris somehow become lodged within the flex track 30, the substantially uniform cross-sectional shape of the flex track 30 permits a wearer to readily dislodge the debris by shaking the shoe, banging the shoe, for instance with the heel of a palm or against a tree trunk or a rock, or by sliding a narrow tool such as a paperclip through the top slit 32 and into the flex track 30.

The track 20 and the connector 26 may each be formed from any number of materials. By way of example only, the track 20 and/or the connector 26 may comprise thermoplastic urethane (TPU), thermoplastic rubber (TPR), plastic resin (such as PEBAX® brand plastic resin), nylon, polyester elastomer (such as HYTREL® brand polyester elastomer), or any combination thereof. Different elements of the track 20 (such as the arms 28*a,b* and the flange 38), and/or different elements of the connector 26 (such as the extended bead 46, the attachment section 44*a*, the connection section 44*b*, and/or the straight member 44') may comprise the same or different materials, or the same or different combinations of materials. In a preferred example, the track 20 and the connector 26 both comprise TPU. In another example, the track 20 comprises TPR and the connector 26 comprises TPU. In yet another example, the track 20 comprises a soft, flexible rubber and the connector 26 comprises a soft, flexible TPU that has rigidity greater than the rubber of the track 20. Preferably, the track 20 is formed of a single molded piece of material. Desirably, the connector 26 is formed of a single molded or extruded piece of material.

FIGS. 7(*a*)-(*d*) illustrate a gaitor-shoe connection where the interface between the track 20 and the connector 26 is in the collar or foot entry region 22 of the upper 14. FIG. 7(*a*) illustrates the shoe 10 with the track 20 disposed in the collar region 22. The track 20 may be attached to the collar region 22 by sewing the flange 38 to the material of the collar region 22. Alternatively, the track 20 may otherwise be affixed, for instance by gluing the flange 38 or the back of the track 20 to the collar region 22. In another alternative, the track 20 may be formed as part of the collar region 22, for example by integrally fabricating the track 20 as part of a component within/along the collar region 22.

FIG. 7(*b*) illustrates a side view of the shoe 10 with the gaitor 24 attached thereto. In this type of collar attachment, the gaitor protects the collar region 22 and the wearer's ankle. Of course, it should be understood that it is possible to extend the top 48 of the gaitor 24 inches above the top of the collar region 22, for instance beyond the location of the wearer's ankle. By way of example only, the top 48 may extend 1-6 inches, 2-5 inches, 4 inches or more above and about the wearer's ankle for protection of the wearer's ankle and the adjacent leg area. In certain environmental conditions, such as very wet or cold climates, the top 48 may be positioned to extend at least 5-12 inches above the wearer's ankle or other acceptable height to provide protection for the wearer's leg.

FIG. 7(*c*) illustrates a perspective view of the gaitor 24 attached to the upper 14 along the collar region 22. In addition the releasable connection interface between the track 20 and the connector 26, it may be preferable to include one or more supplemental connectors at other places on the upper 14 or elsewhere on the shoe 10. For instance, as seen in FIG. 7(*c*), the upper 14 may include a receptacle 50 such as a D ring that is fastened or integral with the lacing region 52 or other closure or securing region of the upper 14. The gaitor 24 may include, by way of example only, a clip, hook, snap, drawcord or drawstring, hook and loop fastener or other fastener 54 for removably attaching to the receptacle 50. The fastener 54 may be attached, preferably permanently attached, to the gaitor 24 by webbing 56 or some other attaching means. Additional receptacles 50 may be placed elsewhere on the shoe 10, for example along heel region 58 of the upper 14. See FIG. 1(*a*). The gaitor 24 may include an additional clip, hook, snap, drawcord or drawstring, hook and loop fastener or other fastener 54 on the back thereof for removably attaching to the receptacle 50 along the heel region 58.

FIG. 7(*d*) illustrates one method of removing the connector 26 from the track 20. In this method, as seen in FIG. 7(*d*)(1), at least the arms 28*a,b* of the track 20, including the flex track 30, preferably comprise rubber or TPR, which permits some flexibility and/or deformability of the arms 28*a,b*. Furthermore, as seen in FIG. 7(*d*)(2), at least the extended bead 46 of the connector 26 preferably comprises TPU. The TPU of the extended bead 46 is desirably harder than the rubber or TPR of the arms 28*a,b*. When the connector 26 is partly or fully engaged with the track 20, it is possible to pull or rip the gaitor 24 from the shoe 10 as seen in FIG. 7(*d*)(3) because the rubber or TPR of the arms 28*a,b* is selected so that the arms 28*a,b* may expand outward, enlarging the top slit 32, whereby the top slit 32 becomes at least as large as the extended bead 46. Desirably, as seen in FIG. 7(*d*)(4), the extended bead 46 has a rounded or oval shape as opposed to a shape with sharp angles such as approximately 90 degrees, because the rounded or oval shape promotes easy and quick removal from the flex track 30.

Figure 8A:
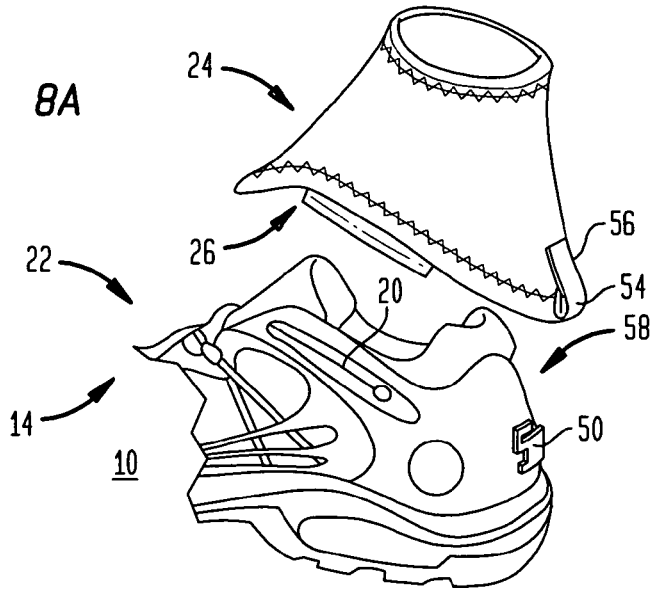
FIGS. 8(*a*)-(*c*) illustrate a method of connecting a gaitor to a shoe in accordance with aspects of the present invention.
Figure 8B:
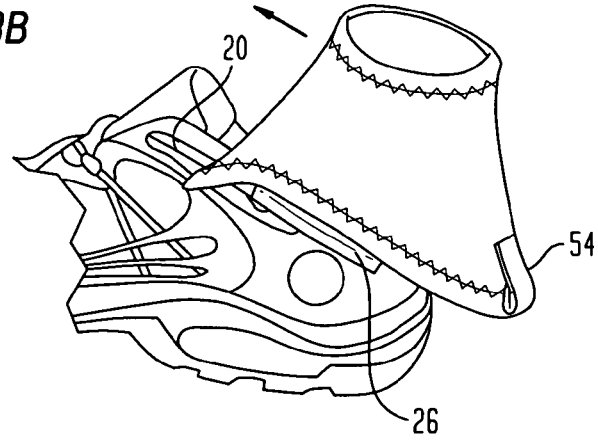
Figure 8C:
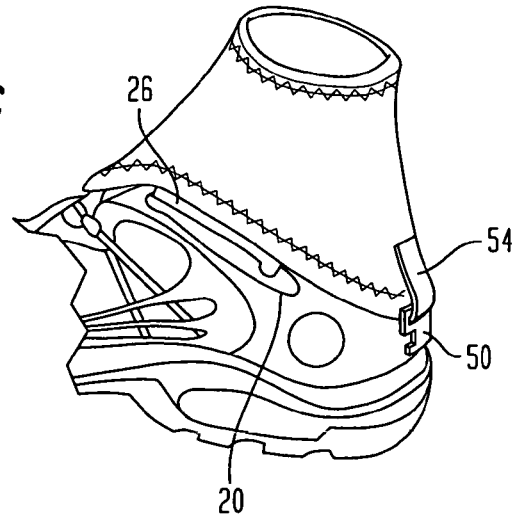

FIGS. 8(*a*)-(*c*) illustrate an example of how to attach the gaitor 24 to the collar region 22 of the upper 14 in accordance with a preferred embodiment of the invention. FIG. 8(*a*) illustrates the gaitor 24 separate from the shoe 10. In FIG. 8(*b*), the connector is aligned with the track 20 and inserted therein. More specifically, the elongated bead (or a first one of the discrete beads) 46 is placed into the opening 34 and then the elongated bead 46 is slid forward into the flex channel 30 until the elongated bead 46 is fully inserted and/or the stop 36 is reached, as seen in FIG. 8(*c*). Then, if there is a supplemental connector such a receptacle 50 on the shoe 10 and a fastener 54 on the gaitor 24, the fastener 54 is removably attached to the receptacle 50. Preferably, a pair of tracks 20 are disposed along the collar region 22, a first one of the tracks 20 on the medial side of the collar region 22, and a second one of the tracks on the lateral side of the collar region 22.

In the embodiment described above in relation to FIGS. 7(*a*)-(*c*), the gaitor 24 can be pulled or ripped away from the shoe 10. However, in an alternative embodiment, the gaitor 24 is disengaged from the shoe 10 by sliding the elongated bead 46 out from the flex track 30 in the reverse order described in relation to FIGS. 8(*a*)-(*c*). This sliding disengagement is preferable when the materials of the arms 28*a,b* and/or the elongated bead 46 are not malleable or soft. For instance, in a preferred embodiment, the arms 28*a,b* and the elongated bead 46 comprise rigid or semi-rigid materials, such as rigid or semi-rigid TPU, nylon or PEBAX®.

As discussed above, the length of the elongated bead 46, the connection section 44*b* and/or the length of the straight member 44' is at least as great as the length of the flex track 30. In cases where the flex track 30 is shorter, it should be understood that at least a portion of the elongated bead 46, the connection section 44*b* and/or the straight member 44' will stick out of the flex track 30. Whether or not elongated bead 46, the connection section 44*b* or the straight member 44' protrudes from the flex track 30, it may be desirable to include a mechanism to prevent the connector 26 from unintentionally pulling out of the track 20. Therefore, as mentioned earlier, it may be preferable to include the locking post 40 as part of the track 20.

Figure 9A:
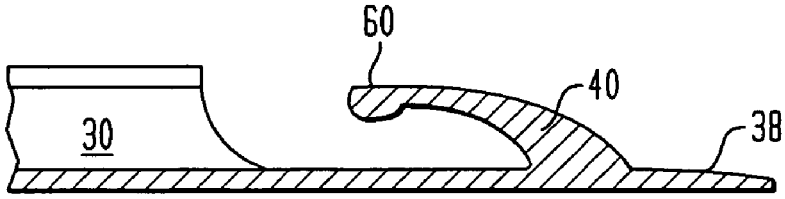
FIGS. 9(*a*)-(*c*) illustrate a locking post for use in accordance with aspects of the present invention.
Figure 9B:
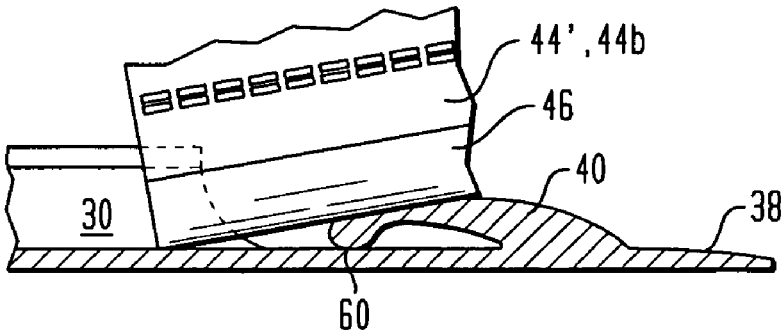
Figure 9C:
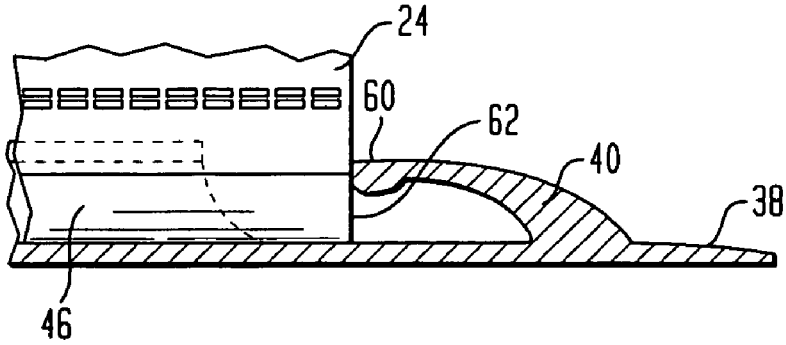
Figure 10A:
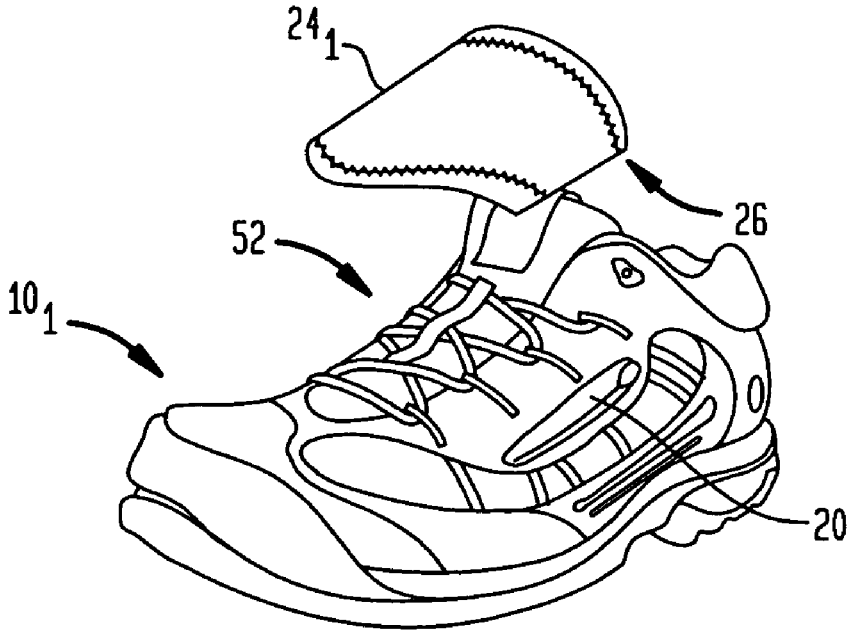
FIGS. 10(*a*)-(*d*) illustrate a gaitor connecting to a lacing region of a shoe in accordance with aspects of the present invention.
Figure 10B:
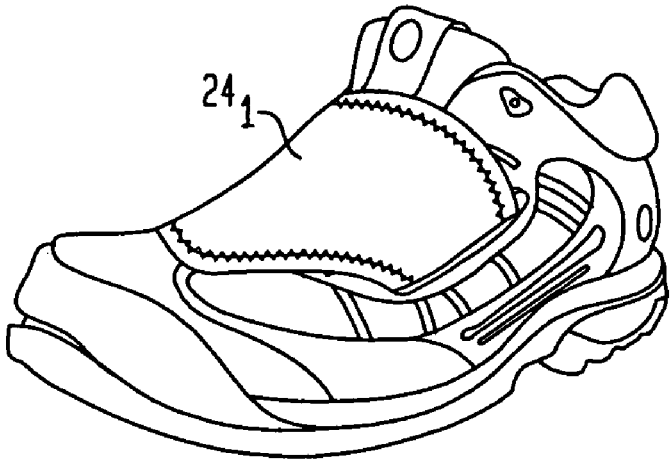
Figure 10C:
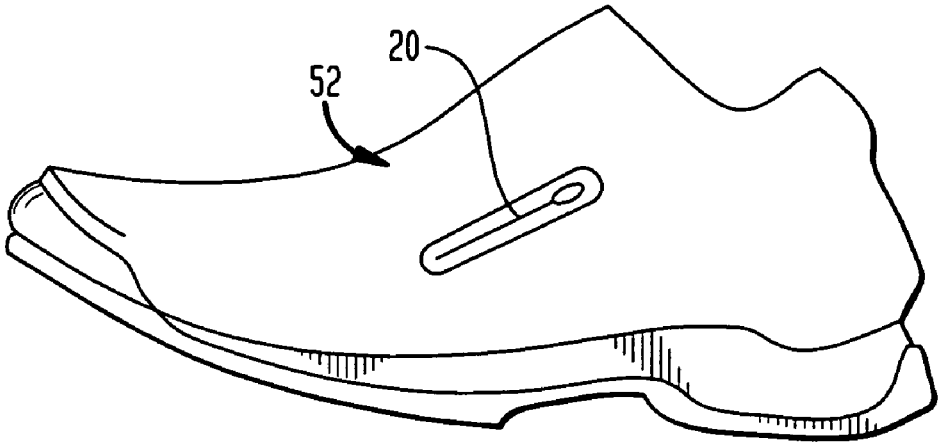
Figure 10D:
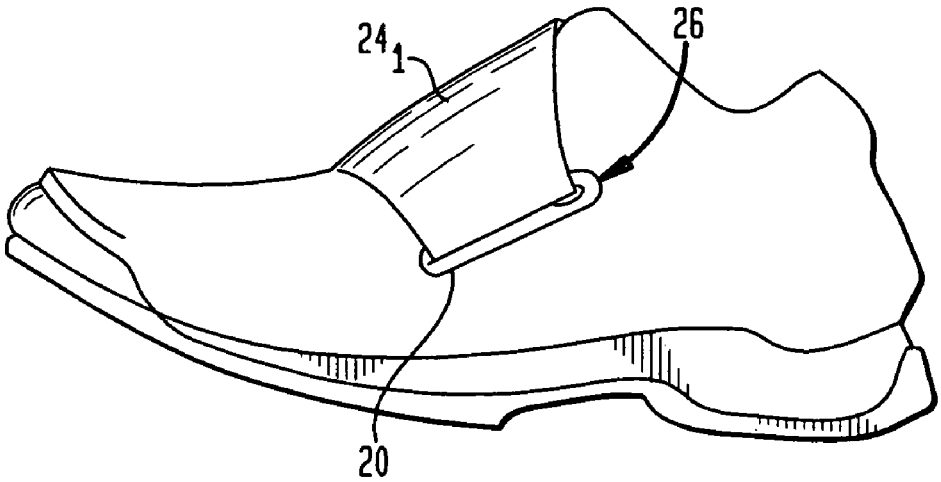
Figure 11A:
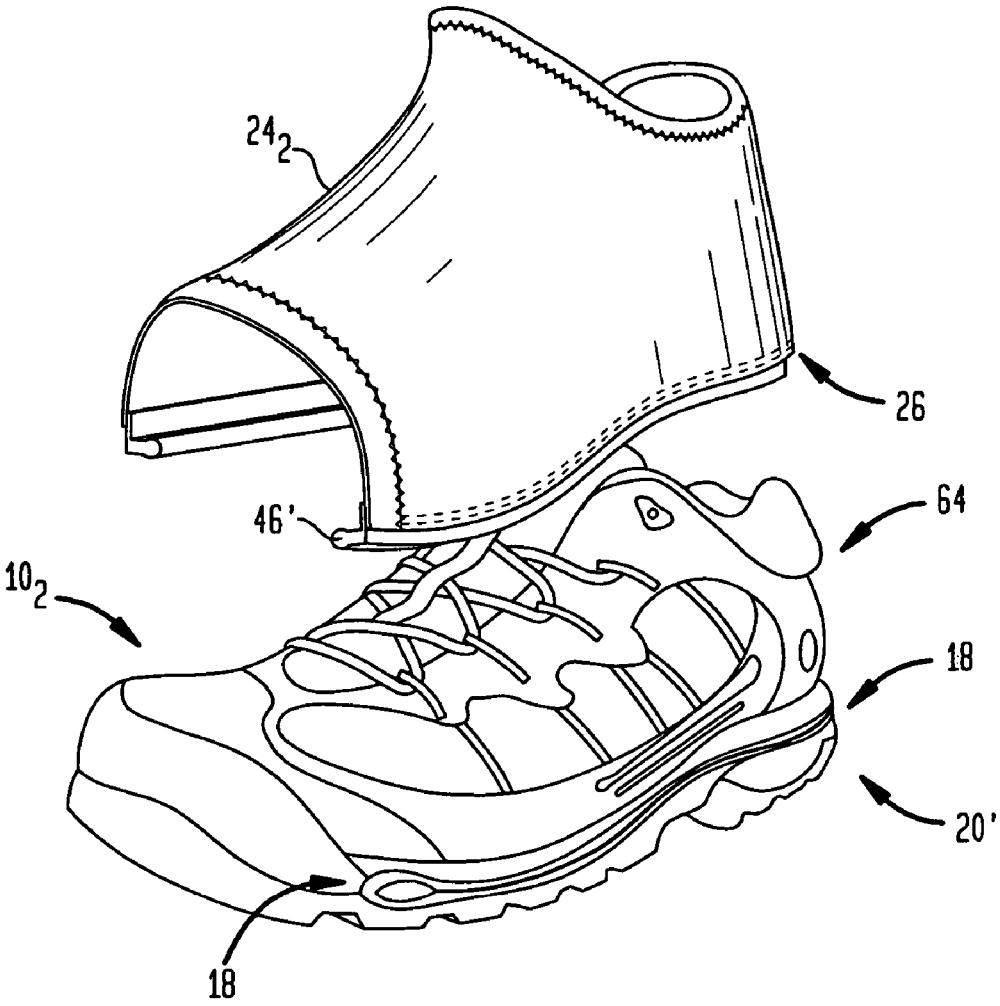
FIGS. 11(*a*)-(*i*) illustrate a gaitor connecting to a midsole or outsole of a shoe in accordance with aspects of the present invention.
Figure 11B:
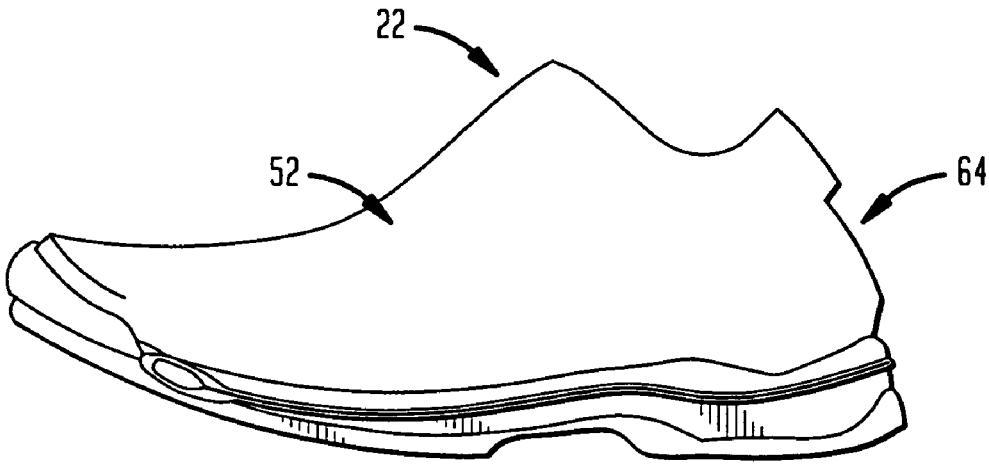
Figure 11C:
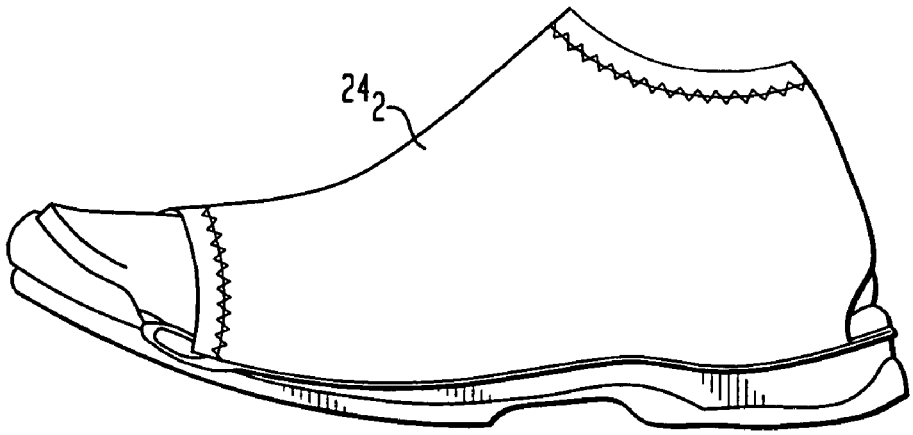
Figure 11D:
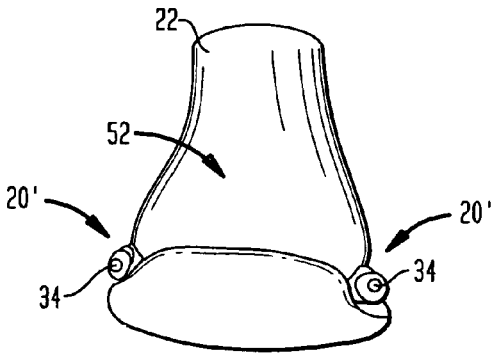
Figure 11E:
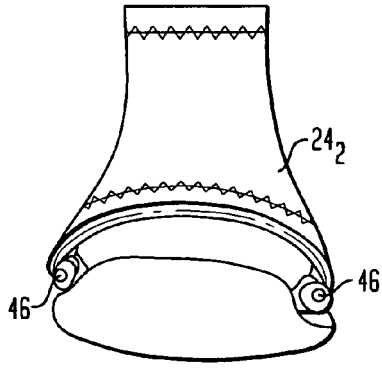
Figure 11F:
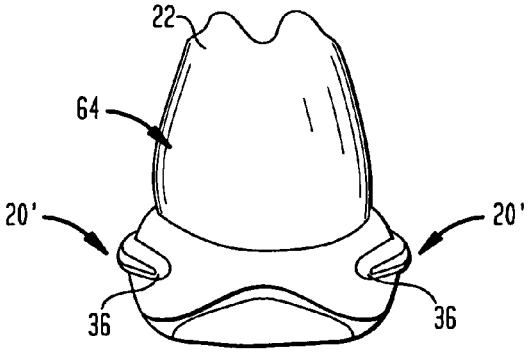
Figure 11G:
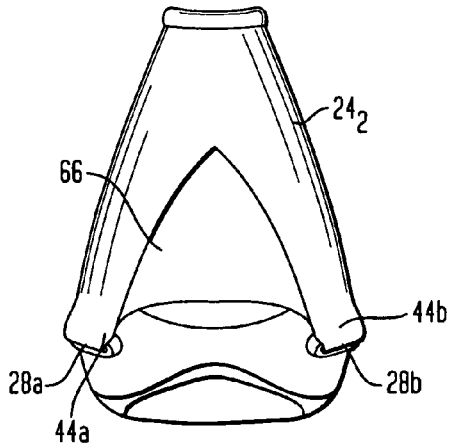
Figure 11H:
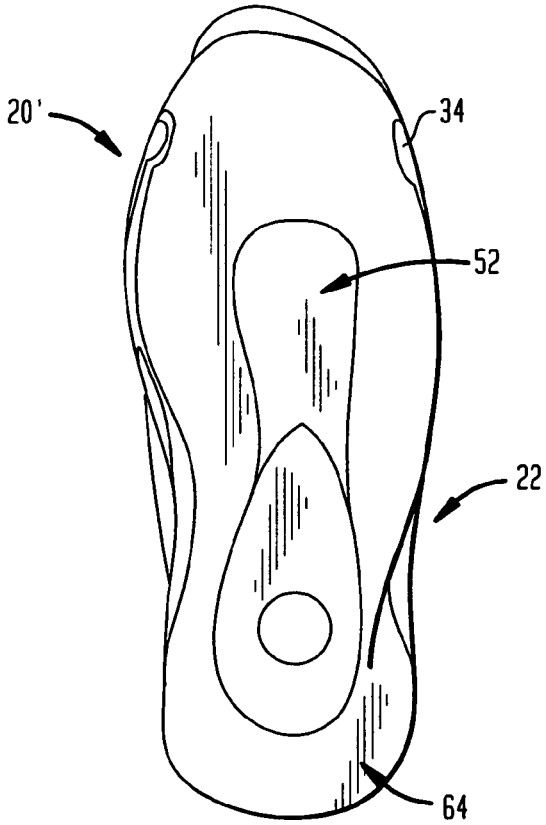
Figure 11I:
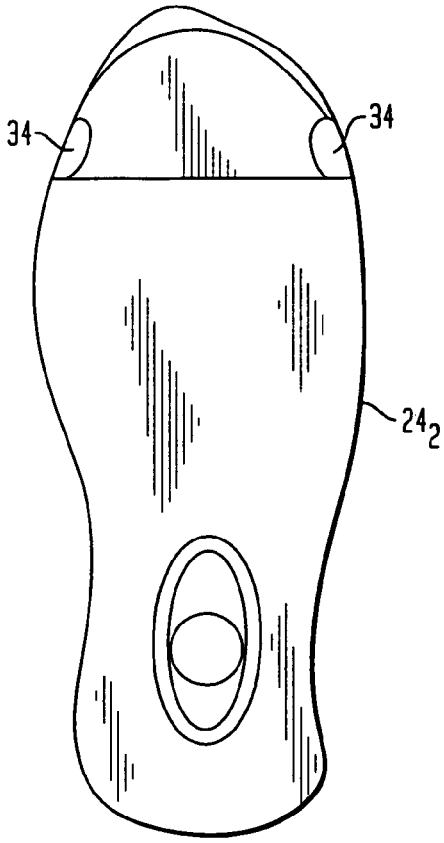
Figure 12A:
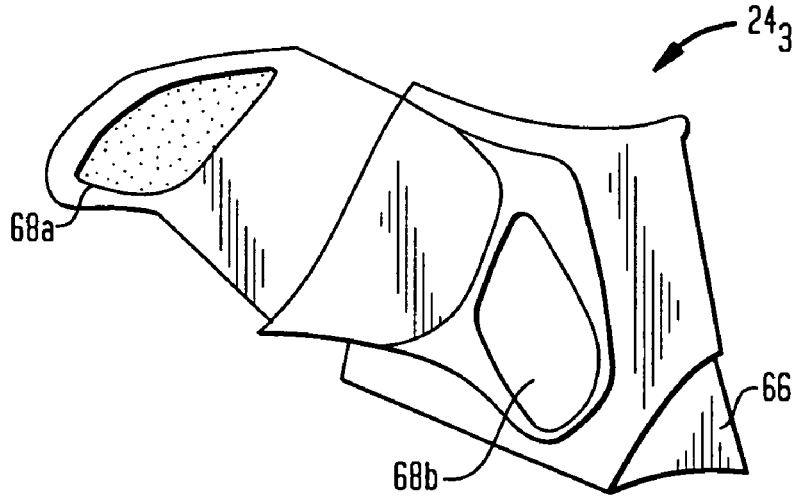
FIGS. 12(*a*)-(*d*) illustrate an alternative gaitor connecting to a shoe in accordance with aspects of the present invention.
Figure 12B:
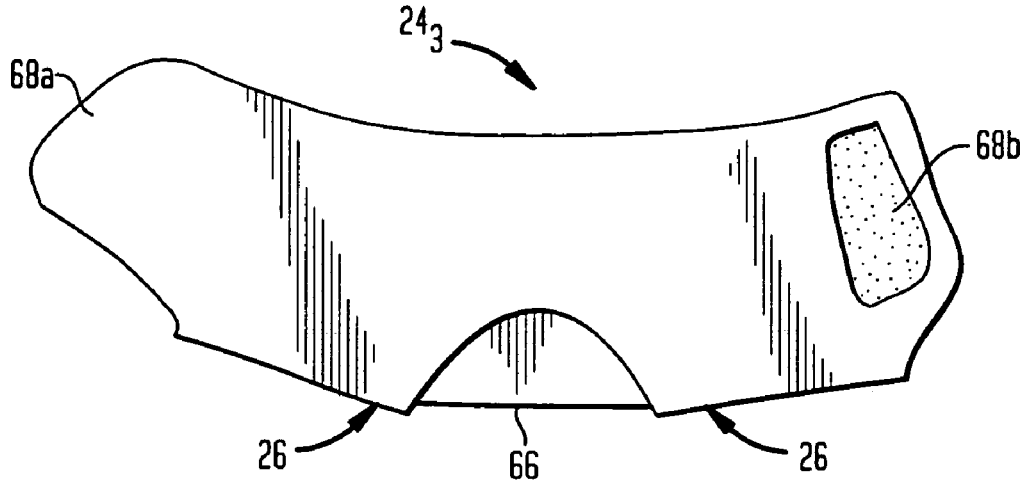
Figure 12C:
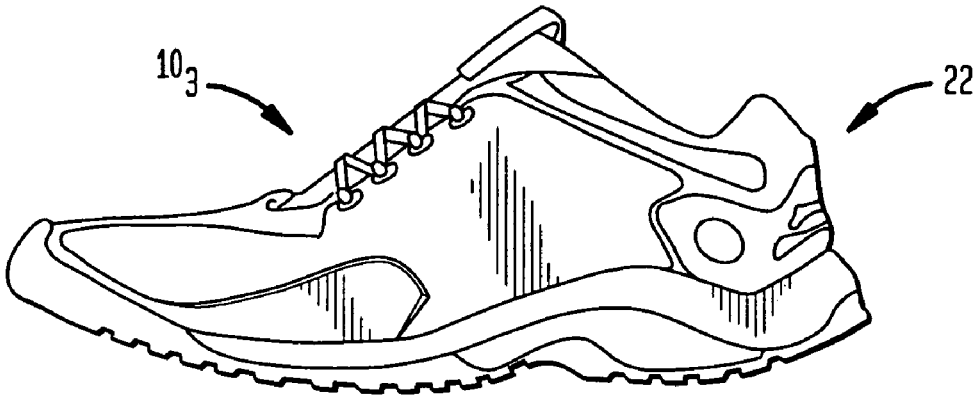
Figure 12D:
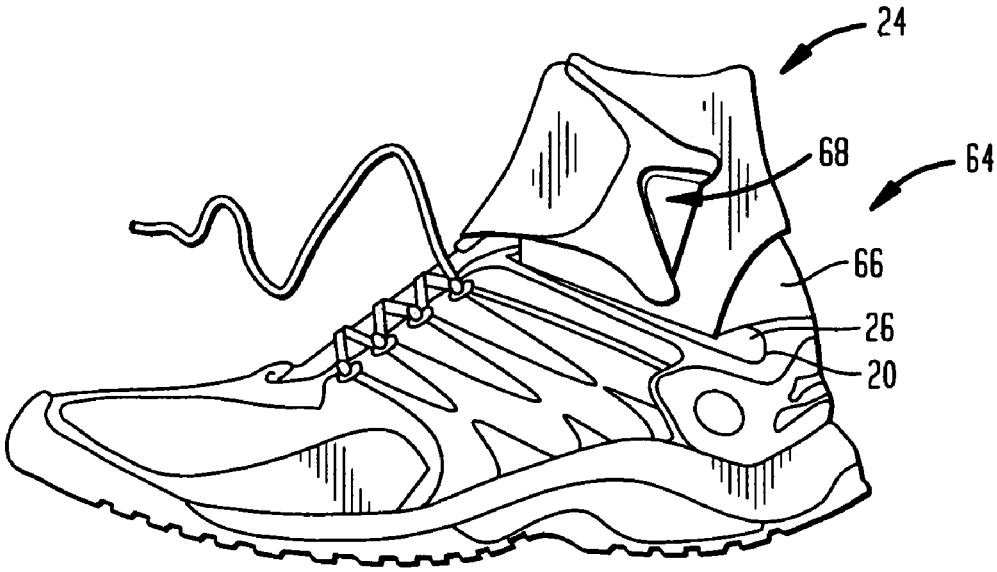

FIGS. 9(*a*)-(*c*) illustrate how the locking post 40 functions to prevent unintentional removal of the connector 26 from the track 20. FIG. 9(*a*) illustrates a cross-sectional view of the flex track 30 and the locking post 40. The locking post preferably includes a head 60 facing towards the flex track 30. As seen in FIG. 9(*b*), as the bead 46 is inserted into the flex track 30, the head 60 of the locking post 40 may be compressed downward. Once the bead 46 is substantially or fully inserted into the flex track 30, the head 60 of the locking post 40 is no longer compressed downward, as seen in FIG. 9(*c*). While some movement of the bead 46 is possible along the flex track 30, the endwall 62 of the bead 46 cannot move farther than the head 60 of the locking post.

Thus, it can be seen that the locking post 40 prevents the bead 46 of the connector 26 from accidentally pulling out from the flex track 30 of the track 20. In order to intentionally remove the connector 26 from the track 20, the user merely needs to reverse the steps described above in relation to FIGS. 9(*a*)-(*c*), in particular compressing the head 60 of the locking post 40 so that the bead 46 can be pulled from the flex channel 30.

As discussed above, different shapes and/or styles of gaitors 24 may be placed over different portions of the shoe 10, and may connect at different places on the shoe 10. Preferably, a pair of connectors 26 removably attach to a pair of tracks 20. One of tracks 20 is preferably on the medial side of the shoe 10, and the other one of the tracks 20 is preferably on the lateral side of the shoe 10.

FIGS. 10(*a*)-(*d*) illustrate an alternative embodiment in which a gaitor $\mathbf{24}_1$ covers the lacing region 52 of a shoe $\mathbf{10}_1$. As seen in the perspective view of FIG. 10(*a*), the track 20 is preferably disposed adjacent to the laces in the lacing region 52. Preferably, a first track 20 is placed on the medial side of the lacing region 52 and a second track 20 is placed on the lateral side of the lacing region 52. FIG. 10(*b*) illustrates the connector 26 of the gaitor $\mathbf{24}_1$ attached to the track 20. The connector 26 can attach to and detach from the track 20 in any of the methods described above. FIGS. 10(*c*)-(*d*) illustrate side views of the uncovered and covered lacing region 52, respectively.

The length of the track 20 and/or the length of the connector 26 may vary depending upon the length of the lacing region 52. By way of example only, if the length of the lacing region is between 100-140 mm, then the overall length of the track may be between 60-140 mm, and the overall length of the connector may be between 60-150 mm. If the shoe $\mathbf{10}_1$ is a boot, for example, and if the length of the lacing region is between 140-250 mm, then the overall length of the track 20 may be between 100-250 mm, and the overall length of the connector may be between 100-260 mm.

Alternatively, for relatively long lacing regions 52, for instance between about 150-300 mm, there may be two or more tracks 20 and two or more corresponding connectors 26 on one or both of the medial and lateral sides of the lacing regions 52 of the shoe $\mathbf{10}_1$. In this case, each track 20 may have an overall length of between 40-80 mm and each connector 26 may have an overall length of between 40-90 mm.

FIGS. 11(*a*)-(*i*) illustrate an alternative embodiment in which a gaitor $\mathbf{24}_2$ covers the lacing region 52, the collar region 22 and at least a portion of heel region 64 of a shoe $\mathbf{10}_2$. As seen in the perspective view of FIG. 11(*a*), track 20' is preferably disposed along the exterior of the region 18, which is desirably a midsole 18. Alternatively, the track 20' may be disposed along the outsole 12, or along both the midsole 18 and the outsole 12. Preferably, a first track 20' is placed on the medial side of the midsole 18 and a second track 20' is placed on the lateral side of the midsole 18. The track(s) 20' preferably follows a contour of the midsole 18, and need not be flat. More preferably, the track(s) 20' is integrally formed as part of the midsole 18. Connector 26', in particular bead 46', preferably also follows the contour of the midsole 18.

Alternatively, the bead 46' (or discrete bead segments) and optionally the connection section 44*b* and/or the attachment section 44*a* (or the straight member 44') may comprise a flexible material such as rubber or TPR. The flexible material should be selected to permit the bead 46' or the discrete bead segments and the connection section 44*b* to follow the contour of the channel or flex track 30 within the track 20'.

FIGS. 11(*b*)-(*c*) illustrate, respectively, side views of the uncovered and covered lacing region 52, collar region 22, and heel region 64 of the shoe $\mathbf{10}_2$. FIGS. 11(*d*)-(*e*) illustrate, respectively, front views of the uncovered and covered shoe $\mathbf{10}_2$, in particular the uncovered and covered lacing region 52 and collar region 22. FIGS. 11(*f*)-(*g*) illustrate, respectively, back views of the uncovered and covered shoe $\mathbf{10}_2$, in particular the uncovered and covered heel region 64 and collar region 22. As seen in the covered back view of FIG. 11(*g*), the gaitor $\mathbf{24}_2$ may include a flexible material 66 such as a stretchable gore. The flexible material 66 permits extra stretching along the heel region 64. FIGS. 11(*h*)-(*i*) illustrate, respectively, top views of the uncovered and covered shoe $\mathbf{10}_2$, in particular the uncovered and covered lacing region 52, collar region 22, and heel region 64.

The length of the track 20' and/or the length of the connector 26' may vary depending upon the length of the shoe $\mathbf{10}_2$. By way of example only, if the length of the shoe $\mathbf{10}_2$ is between 200-260 mm, then the overall length of the track 20' may be between 150-250 mm, and the overall length of the connector may be between 150-260 mm. Alternatively, the overall length of the track 20' may be 160 mm or less, for example between 20 mm and 150 mm, and the overall length of the connector may be 155 mm or less, for example between 15 mm and 145 mm. If the shoe $\mathbf{10}_2$ is a very large shoe, for example, and if its length is between 250-450 mm, then the overall length of the track 20' may be between 200-430 mm, and the overall length of the connector may be between 200-440 mm. Alternatively, the overall length of the track 20' may be 400 mm or less, for example between 20 mm and 380 mm, and the overall length of the connector may be 390 mm or less, for example between 15 mm and 385 mm.

Alternatively, for relatively long shoes $\mathbf{10}_2$, for instance between about 300-450 mm, there may be two or more tracks 20' and two or more corresponding connectors 26' on one or both of the medial and lateral sides of the midsole 18 of the shoe $\mathbf{10}_2$. In this case, each track 20' may have an overall length of between 40-80 mm and each connector 26' may have an overall length of between 40-90 mm. However, the overall length of each track 20' may be less than half the length of the long shoe $\mathbf{10}_2$, although it is not necessary for each track 20' or each connector 26' to be the same length. For instance different tracks may range between 10 mm and 90 mm, and the overall lengths of each connector 26' may be less than 10 mm or anywhere up to the full length of the track.

As discussed above, gaitors used in accordance with the present invention may have any configuration desired, and may be made from a wide variety of materials. FIG. 11(*g*) illustrated gaitor $\mathbf{24}_2$ as having a piece of stretchable gore 66 along the back thereof. Supplemental fasteners may also be used to permit the wearer to more easily place the gaitor over the shoe and/or around the leg.

FIGS. 12(*a*)-(*b*) illustrate gaitor $\mathbf{24}_3$ having the gore 66 as well as a fastener 68. The fastener 68 may comprise any releasable fastener. By way of example only, the fastener 68 may comprise a snap fastener, a hook fastener, a clip fastener and/or a hook and loop fastener. Preferably, the fastener 68 comprises a hook and loop fastener, wherein a first part of the fastener 68 comprises hooks 68*a* and a second part of the fastener 68 comprises loops 68*b*. Of course, it should be understood that the placement of the hooks 68*a* and the loops 68*b* may be reversed. FIGS. 12(*c*)-(*d*) illustrate a shoe $\mathbf{10}_3$ without the gaitor $\mathbf{24}_3$ and with the gaitor $\mathbf{24}_3$, respectively. As best seen in FIG. 12(*d*), the gore 66 provides additional stretch along the heel region 64, particularly, where the heel region 64 and the collar region 22 overlap. Preferably, once the connector 26 engages the track 20, the gaitor $\mathbf{24}_3$ may be wrapped around the wearer's ankle and the hooks 68*a* may be fastened to the loops 68*b* of the fastener 68, providing a snug fit about the ankle.

In the embodiments discussed above, the opening 34 of the track 20 may be positioned towards the front or toe region of the shoe relative to the rest of the track 20, or may positioned towards the rear or heel region of the shoe relative to the rest of the track 20. The placement of the opening 34 may face forward or rearward for any track 20 in accordance with the invention. Furthermore, in an alternate embodiment, the track 20 may be fastened to the gaitor 24, and the connector 26 may be fastened to the shoe 10. In this embodiment, the track 20 may fasten to the connector 26 in a manner equivalent to the methods described above.

Figure 13:
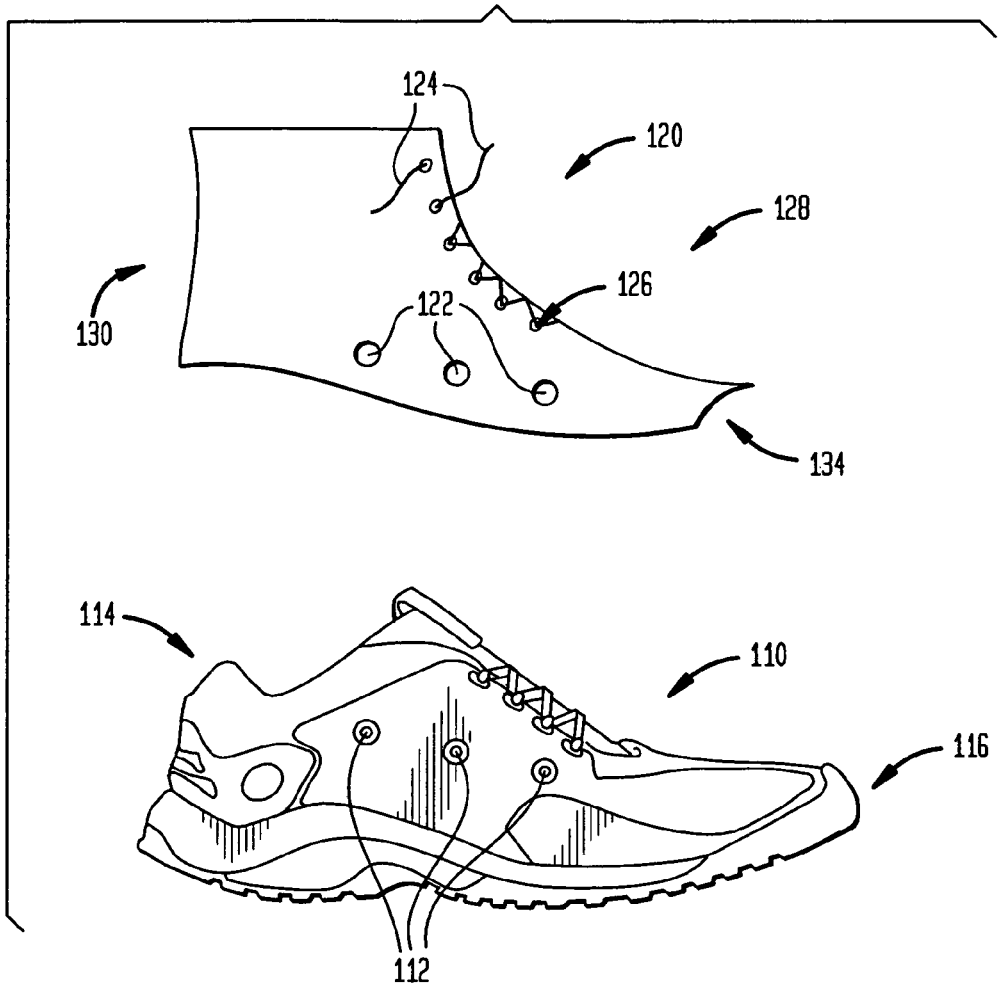
FIG. 13 is a perspective view of a low profile boot and collar according to aspects of the present invention.

Referring to FIG. 13, another preferred embodiment of the invention is a low profile boot 110 containing a plurality of fasteners 12 arranged along the side portion 116 of the boot 110 as shown. Except for the presence of the fasteners, the boot 110 may be described as an otherwise normal low profile or chukka style boot.

As shown in FIG. 13, boot collar or gaitor 120 contains a heel section 130 and a midfoot section 128. The boot collar 120 has a plurality of complementary fasteners 122 arranged along the lower section 134 of the collar. The midfoot section of the collar 120 is shown open along the lengthwise section thereof, permitting the collar 120 to be secured to the foot and ankle of the wearer by tying laces 124. The laces 124 are threaded through eyelets 126 in the conventional manner for lacing a boot.

The collar 120 is secured to the chukka boot 110 using the fasteners 122 on the bottom section of the collar 120, and the complementary fasteners 112 on the side of the boot 110. Although snaps are shown in the particular embodiment depicted in FIG. 13, it will be readily appreciated that functionally equivalent fasteners can also be used to advantage. Such fasteners include buttons, VELCRO strips, zippers, the slidably engaging fasteners described above, and the like, as will be understood by those skilled in the art.

Figure 14:
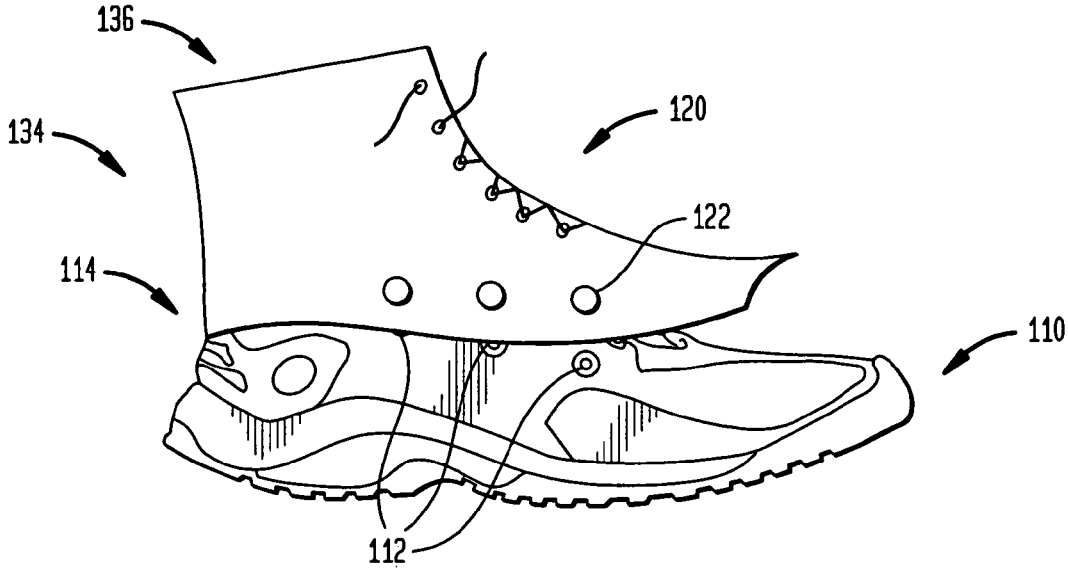
FIG. 14 is a perspective view showing a collar being fitted on a low profile boot according to aspects of the present invention.
Figure 15:
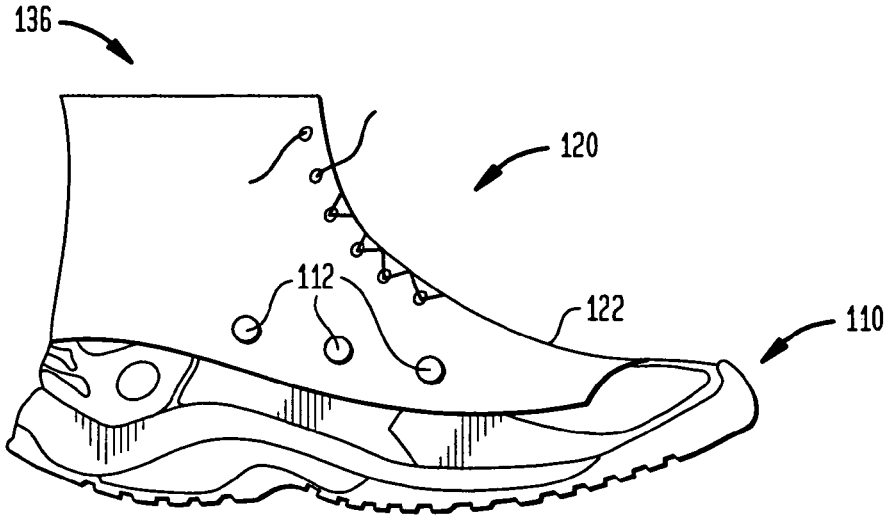
FIG. 15 is a perspective view showing a collar affixed to the low profile boot to form a high profile boot according to a conversion method of the present invention.

FIG. 14 depicts the attachment of the collar 120 to the boot 110. The bottom section 134 of the collar 120 is configured to slip over the top 114 of boot 110 and align with the midfoot and heel sections of the boot 110. Boot fasteners 112 engage complementary collar fasteners 122 and are secured in place. The completed assembly of the boot 110 and the collar 120 is shown in FIG. 15.

In use, the wearer can slip his or her foot into the top portion 136 of the collar 120 and into the body of boot 110. The laces 124 are tied to secure the boot 110 to the foot of the wearer. In one embodiment, the laces 124 can lock into prongs or hooks in the chukka boot 110 to further secure the collar 120 and boot 110.

The collar 120 can be reversible or non-reversible, and several different styles and types of collars 120 can be used with a single shoe. A reversible collar 120 can include functional features on both the inside and outside surfaces of the collar 120, such as a hydrophobic (waterproof) coating on one surface, and an insulation material on the other surface. Thus, the inside surface of the collar 120 can be an insulation material in cold weather, and a waterproof material in warmer but rainy weather. Alternatively, the collar 120 can have different non-functional or aesthetic designs on both sides in a reversible format to change the appearance of the shoe 110 at the discretion of the wearer.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. By way of example only, while different embodiments described above illustrate specific features, it is within the scope of the present invention to combine or interchange different features among the various embodiments to create other variants.

Any of the features in any of the embodiments can be combined or interchanged with any other features in any of the other embodiments. By way of example only, the placement of the gaitor interface, the shapes of the channel and interconnecting bead, and different types of supplemental fasteners can be used in combination and/or interchanged. The reversible collar lining may be employed with connectors such as the track system, and may connect to any portion of the shoe, such as the collar, midsole or outsole.

The invention claimed is:

1. A gaitor interface for releasably connecting a gaitor to a shoe, the gaitor interface comprising:

a track including a pair of arms and a flange, the pair of arms having upper ends curved towards one another defining an interior region of the track, the flange being adapted for attachment to a surface of the shoe; and a connector comprising an attachment section and a connection section, the attachment section being attachable to a surface of the gaitor, and the connection section being adapted to be slidably inserted into and removed from the interior region of the track;

wherein the pair of arms extend along the length of the track from a first side of the track to a second side remote from the first side, the pair of arms tapering lengthwise along the length toward one another from the first side of the track to the second side of the track.

2. The gaitor interface of claim 1, wherein the connection section includes an elongated bead disposed along an edge thereof, and the elongated bead is slidably insertable into the interior region of the track.

3. A gaitor interface for releasably connecting a gaitor to a shoe, the gaitor interface comprising:

a track including a pair of arms and a flange, the pair of arms having upper ends curved towards one another defining an interior region of the track, the flange being adapted for attachment to a surface of the shoe; and a connector comprising an attachment section and a connection section, the attachment section being attachable to a surface of the gaitor, and the connection section being adapted to be slidably inserted into and removed from the interior region of the track;

wherein the track further includes a stopping member disposed on the flange opposite an opening into the interior region of the track, and when the connector is received within the interior region, the stopping member prevents accidental removal of the connector.

4. A shoe, comprising:

an outsole for contacting the ground;

an upper connected to the outsole; and a pair of tracks disposed on the shoe, the tracks each including an elongated pathway adapted to slidably receive a gaitor, the elongated pathway having a first end and a second end remote from the first end, the first end having an arcuate ramped opening adapted to receive a connector from a gaitor, the arcuate ramped opening extending from a top section of the elongated pathway to a base section thereof;

wherein the arcuate ramped opening provides a guided region for the gaitor connector to enter the elongated pathway.

5. The shoe of claim 4, wherein the tracks each comprise a pair of arms and a flange, the pair of arms having upper ends curved towards one another to defining the elongated pathway, the flange being adapted for attachment to a shoe surface.

6. The shoe of claim 5, wherein the upper includes a collar region, a first one of the tracks is disposed on a medial side of the collar region, and a second one of the tracks is disposed on a lateral side of the collar region.

7. The shoe of claim 5, wherein the upper includes a closure region, a first one of the tracks is disposed on a medial side of the closure region, and a second one of the tracks is disposed on a lateral side of the closure region.

8. The shoe of claim 5, wherein a first one of the tracks is disposed on a medial side of the outsole, and a second one of the tracks is disposed on a lateral side of the out sole.

9. The shoe of claim 5, wherein the shoe further comprises a midsole between the upper and the outsole, a first one of the tracks is disposed on a medial side of the midsole, and a second one of the tracks is disposed on a lateral side of the midsole.

10. A shoe, comprising:

an outsole for contacting the ground;

an upper connected to the outsole; and a pair of tracks disposed on the shoe, the tracks each including an elongated pathway adapted to slidably receive a gaitor;

wherein the tracks each comprise a pair of arms and a flange, the pair of arms having upper ends curved towards one another to defining the elongated pathway, the flange being adapted for attachment to a shoe surface, and wherein at least one of the tracks further includes a hinge disposed on the flange opposite an opening into the elongated pathway of the track, and when a connector of the gaitor connector is received within the elongated pathway the hinge prevents removal of the gaitor connector.

11. A shoe, comprising:

a gaitor adapted to cover at least a portion of the shoe, the gaitor including a covering, a pair of connectors secured to the covering, and a gaitor fastener secured to the covering;

an outsole for contacting the ground;

an upper connected to the outsole; and a pair of receptacles disposed on the upper or the outsole, the receptacles each including an elongated pathway adapted to slidably receive one of the connectors;

at least one of the receptacles being disposed on the upper, the at least one receptacle being adapted to receive the gaitor fastener to secure the gaitor to the upper.

12. The shoe of claim 11, wherein each connector comprises an attachment section and a connection section, the attachment section being attachable to the gaitor covering, and the connection section being slidably insertable into a respective one of the elongated pathways.

13. The shoe of claim 12, wherein the connection section is substantially perpendicular to the attachment section.

14. The shoe of claim 13, wherein the connection section includes an elongated bead disposed along an edge thereof, and the elongated bead is slidably insertable into the respective elongated pathway.

15. The shoe of claim 11, wherein both of the receptacles are disposed on an exterior surface of the upper.

16. The shoe of claim 11, wherein a second one of the receptacles is disposed on an exterior surface of the outsole.

17. The shoe of claim 11, wherein the covering of the gaitor includes a stretchable gore.

18. The shoe of claim 11, wherein the covering of the gaitor further includes a releasable fastening mechanism to fasten a first region of the covering to a second region of the covering.

19. The shoe of claim 11, wherein a first surface of the covering comprises a first material and a second surface of the covering comprises a second material.

20. The shoe of claim 11, wherein the gaitor is reversible from a first position to a second position, the first position exposing a first surface of the covering to an outside environment and the second position exposing a second surface of the covering to the outside environment, the second position being obtained by placing the gaitor inside out, wherein the pair of connectors is adapted to be slideably received by the receptacles in the first and second positions.

21. The shoe of claim 20, wherein the first surface includes a hydrophobic layer and the second surface includes an insulating layer.

22. The shoe of claim 21, wherein the hydrophobic layer comprises a waterproof coating.

23. The shoe of claim 20, wherein the first and second surfaces provide different appearances.

24. The shoe of claim 11, wherein the receptacles each comprise a track including a pair of arms and a flange, the pair of arms having inward curving upper ends defining the elongated pathway, the flange being adapted for attachment to a surface of the shoe.

25. The shoe of claim 11, wherein the at least one receptacle is disposed on an instep region of the upper.

26. The shoe of claim 11, wherein:

the at least one receptacle comprises a pair of receptacles, a first one of the pair of receptacles being disposed on a tongue section of the upper and a second one of the pair of receptacles being disposed on a heel section of the upper; and the gaitor fastener comprises a pair of gaitor fasteners, a first one of the gaitor fasteners being adapted to removably connect to the first receptacle and a second one of the gaitor fasteners being adapted to removably connect to the second receptacle.

27. A shoe, comprising:

a gaitor adapted to cover at least a portion of the shoe, the gaitor including a covering and a pair of connectors;

an outsole for contacting the ground;

an upper connected to the outsole; and a pair of receptacles disposed on the upper or the outsole, the receptacles each including an elongated pathway adapted to slidably receive one of the connectors;

wherein a first one of the receptacles further includes a flexible stopper disposed opposite an opening into the elongated pathway, and when a selected one of the connectors is received within the first receptacle, the flexible stopper prevents accidental disengagement of the selected connector from the first receptacle.

28. A gaitor for covering at least a portion of a shoe, the gaitor comprising:

a covering;

a pair of elongated connectors, a first one of the elongated connectors being disposed along a medial side of the covering, and a second one of the elongated connectors being disposed along a lateral side of the covering; and at least one gaitor fastener being disposed along the cover between the pair of elongated connectors, the at least one gaitor fastener being adapted to removably secure the gaitor to a receptacle disposed on an upper of the shoe;

wherein the connectors are adapted to slidably engage an elongated track of the shoe.

29. The gaitor of claim 28, wherein each connector comprises an attachment section and a connection section, the attachment section being attachable to a portion of the covering, and the connection section being adapted to be slidably inserted into and removed from the elongated track of the shoe.

30. The gaitor of claim 29, wherein the connection section includes an elongated bead disposed along an edge thereof, and the elongated bead is slidably insertable into the elongated track.

31. The gaitor of claim 29, wherein the connection section of each connector comprises a bendable material.

32. A method of connecting a gaitor to a shoe, the gaitor including an elongated connection member and the shoe including a track, the track having an elongated pathway having a first end and a second end remote from the first end, the first end having an arcuate ramped opening thereat, the method comprising:

aligning the elongated connection member with the arcuate ramped opening of the track;

sliding the elongated connection member along the arcuate ramped opening; and sliding the elongated connection member into the track until at least 50% of the elongated connection member is received within the track.

33. The method of claim 32, further comprising disconnecting the gaitor from the shoe by sliding the elongated connection member out of the track.

34. The method of claim 32, further comprising disconnecting the gaitor from the shoe by pulling an end of the elongated connection member substantially perpendicularly away from the track.

* * * * *